US010933431B2

(12) United States Patent
Kochiyama et al.

(10) Patent No.: US 10,933,431 B2
(45) Date of Patent: Mar. 2, 2021

(54) ELECTRIC DUST COLLECTION DEVICE AND MANUFACTURING METHOD THEREFOR

(71) Applicant: Samsung Electronics Co., Ltd, Gyeonggi-do (KR)

(72) Inventors: Yasuhiko Kochiyama, Seongnam-si (KR); Hyong-soo Noh, Suwon-si (KR); Jung-yoon Hahm, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 362 days.

(21) Appl. No.: 15/777,142

(22) PCT Filed: Nov. 3, 2016

(86) PCT No.: PCT/KR2016/012564
§ 371 (c)(1),
(2) Date: May 17, 2018

(87) PCT Pub. No.: WO2017/086636
PCT Pub. Date: May 26, 2017

(65) Prior Publication Data

US 2020/0023377 A1 Jan. 23, 2020

(30) Foreign Application Priority Data

Nov. 20, 2015 (KR) ..... 10-2015-0163016

(51) Int. Cl.
*B03C 3/12* (2006.01)
*B03C 3/47* (2006.01)
(Continued)

(52) U.S. Cl.
CPC ..... *B03C 3/12* (2013.01); *B03C 3/47* (2013.01); *B03C 3/64* (2013.01); *B03C 3/885* (2013.01);
(Continued)

(58) Field of Classification Search
CPC combination set(s) only.
See application file for complete search history.

(56) References Cited

U.S. PATENT DOCUMENTS 2,565,458 A * 8/1951 Weisz ..... B03C 3/45 96/85
4,313,741 A * 2/1982 Masuda ..... B03C 3/12 96/78
(Continued)

FOREIGN PATENT DOCUMENTS

CN 2573904 Y 9/2003
EP 1279439 A2 1/2003
(Continued)

OTHER PUBLICATIONS

International Search Report dated Feb. 17, 2017 in connection with International Patent Application No. PCT/KR2016/012564.
(Continued)

*Primary Examiner* — Christopher P Jones
*Assistant Examiner* — Sonji Turner

(57) ABSTRACT

The present invention relates to an electric dust collection device comprising: an electrification unit; and a dust collection unit provided downstream of the electrification unit, wherein the dust collection unit comprises a plurality of bent parts formed by continuously bending one insulating sheet, each of the plurality of bent parts comprises: two flat surfaces bent so as to face each other at a predetermined interval; and a connection surface connecting respective one ends of the two flat surfaces in the vertical direction and having an opening, one flat surface of the two flat surfaces has an electrode for an anode, and the other one flat surface has an electrode for a cathode.

15 Claims, 22 Drawing Sheets

(51) Int. Cl.
*B03C 3/64* (2006.01)
*B03C 3/88* (2006.01)
*F24F 3/16* (2021.01)

(52) U.S. Cl.
CPC ... *B03C 2201/04* (2013.01); *F24F 2003/1682* (2013.01)

(56) References Cited

U.S. PATENT DOCUMENTS

| | | | | | |
|---|---|---|---|---|---|
| 5,466,279 | A | * | 11/1995 | Hattori | B03C 3/12 96/69 |
| 8,357,233 | B2 | * | 1/2013 | Chan | B03C 3/12 96/69 |
| 8,470,084 | B2 | * | 6/2013 | Ji | B03C 3/12 96/78 |
| 2010/0236411 | A1 | | 9/2010 | Chan | |

FOREIGN PATENT DOCUMENTS

| | | | | |
|---|---|---|---|---|
| EP | 2700451 | A2 | | 2/2014 |
| EP | 2768096 | A1 | | 8/2014 |
| JP | S62-183560 | U | | 11/1987 |
| JP | H04-83587 | A | | 3/1992 |
| JP | H05-285421 | A | | 11/1993 |
| JP | H08117636 | A | | 5/1996 |
| JP | H10-000382 | A | | 1/1998 |
| JP | 2000-015138 | A | | 1/2000 |
| JP | 2000-102745 | A | | 4/2000 |
| JP | 2000102745 | A | * | 4/2000 |
| JP | 2001-96192 | A | | 4/2001 |
| JP | 2011-16056 | A | | 1/2011 |
| KR | 10-0734504 | B1 | | 6/2007 |
| KR | 10-2010-0067572 | A | | 6/2010 |
| KR | 10-2014-0111784 | A | | 9/2014 |
| KR | 10-2015-0009738 | A | | 1/2015 |

OTHER PUBLICATIONS

Witten Opinion of the International Searching Authority dated Feb. 17, 2017 in connection with International Patent Application No. PCT/KR2016/012564.

Office Action dated Apr. 28, 2019 in connection with Chinese Patent Application No. 201680066950.1, 11 pages.

Supplementary European Search Report dated Jul. 24, 2018 in connection with European Patent Application No. 16 86 6588, 19 pages.

* cited by examiner

ELECTRIC DUST COLLECTION DEVICE AND MANUFACTURING METHOD THEREFOR

CROSS-REFERENCE TO RELATED APPLICATIONS AND CLAIM OF PRIORITY

This application is a 371 of International Application No. PCT/KR2016/012564 filed Nov. 3, 2016, which claims priority to Korean Patent Application No. 10-2015-0163016 filed Nov. 20, 2015, the disclosures of which are herein incorporated by reference in their entirety.

TECHNICAL FIELD

The present invention relates to an electric duct collection device, and more particularly, to an electric dust collection device including a dust collecting part formed by continuously bending an insulating sheet and a method of manufacturing the same.

BACKGROUND

High concentrations of aerosols in confined spaces such as homes, rooms, shopping malls, factories, offices, and the like may cause problems for people's health. Such aerosols arise when smoking, cooking such as meat or fish baking, cleaning, welding, grinding, operating an internal combustion engine, etc., in the confined space.

Therefore, an electric dust collection device is widely used to remove such aerosols. Such an electric dust collection device is installed and used in an air cleaner or an air conditioner having an air cleaning function.

An example of a conventional electric dust collection device 100 is illustrated in FIG. 1.

Referring to FIG. 1, the electric dust collection device 100 includes a charging part 110 and a dust collecting part 120 disposed downstream of the charging part 110.

The charging part 110 is composed of a discharge electrode 111 and a correspondence electrode 113. The discharge electrode 111 is formed of a wire electrode provided at the center of a pair of correspondence electrodes 113, and a tungsten wire is generally used as the discharge electrode 111. The pair of correspondence electrodes 113 are provided on the upper side and the lower side of the discharge electrode 111. When a voltage of several KV, for example, 3 to 7 KV, is applied between the discharge electrode 111 and the correspondence electrode 113, a corona discharge is generated in the discharge electrode 111 so that a hemispherical electric field is formed between the discharge electrode 111 and the correspondence electrode 113.

The dust collecting part 120 has a structure in which a plurality of positive electrodes 121 and a plurality of negative electrodes 122 having flat-plate shapes are stacked at a predetermined interval. For example, the positive electrode may be formed by printing a carbon ink on the surface of a laminated film, and the negative electrode 122 may be formed of an aluminum plate. Accordingly, when a predetermined voltage is applied between the positive electrodes 121 and the negative electrodes 122 of the dust collecting part 120, electric fields are formed between the positive electrodes 121 and the negative electrodes 122. Here, the electrode having a high level potential is represented as the positive electrode and the electrode having a low level potential is represented as the negative electrode based on the potential difference between the two electrodes. Hereinafter, the same concept will be used in the description of the present invention.

Therefore, when air conveyed by a fan (not illustrated) provided in front of the charging part 110 passes through the charging part 110, dust in the air is charged to have a positive (+) polarity. The dust charged to have a positive polarity is adhered to the negative electrodes 122 and removed from the air while passing through the dust collecting part 120. Therefore, clean air from which dust is removed is discharged from the dust collecting part 120.

However, in the conventional electric dust collection device 100, since the plurality of positive electrodes 121 and the plurality of negative electrodes 122 are separately manufactured and assembled at predetermined intervals to form the dust collecting part 120, it is difficult to manufacture the dust collecting part 120 and the structure thereof is complicated.

SUMMARY

The present invention has been developed in order to overcome the above drawbacks and other problems associated with the conventional arrangement. An aspect of the present invention relates to an electric dust collection device which is easy to manufacture and has a simple structure by integrally forming a plurality of electrodes constituting a dust collecting part and a manufacturing method of manufacturing the electric dust collection device.

According to an aspect of the present invention, an electric dust collection device may include a charging part; and a dust collecting part provided downstream of the charging part, wherein the dust collecting part may include a plurality of bent portions formed by continuously bending an insulating sheet, wherein each of the plurality of bent portions may include two planes bent to face each other at a predetermined gap; and a connecting wall connecting respective one ends of the two planes in a vertical direction and provided with an opening, and wherein a positive electrode may be formed in one of the two planes and a negative electrode may be formed in another plane.

The positive electrode of each of the plurality of bent portions may be connected to each other and the negative electrode of each of the plurality of bent portions may be connected to each other.

The positive electrode and the negative electrode may be formed by printing with carbon ink or silver-containing paint or by depositing aluminum on a surface of the insulating sheet.

One of the positive electrode and the negative electrode may be formed inside the insulating sheet and another electrode may be formed on a surface of the insulating sheet. A part of the electrode formed inside the insulating sheet may be exposed to an outside for connection with an external power source.

The positive electrode and the negative electrode may be alternately formed in a longitudinal direction of the insulating sheet.

The insulating sheet may include a base film and a cover film which are overlapped with each other, and the one of the positive electrode and the negative electrode may be located between the base film and the cover film.

A width of the cover film may be smaller than a width of the base film and the electrode positioned between the base film and the cover film may be partially exposed to an outside of the cover film.

A plurality of gap holding members may be provided between the two planes of the plurality of bent portions.

The plurality of gap holding members may be provided on ends opposite to the connecting walls of the two planes of the bent portions.

The gap holding members may be formed of a conductive material.

Portions of the plurality of gap holding members may protrude from one ends of the two planes of the bent portions and may be in contact with each other.

The plurality of gap holding members may be formed of a thermally fusible adhesive or a double-sided tape.

Each of the two planes of the bent portions may include a middle part in which an electric field forming portion of the positive electrode or the negative electrode is provided and connecting parts in which a power connection part of the positive electrode or the negative electrode is provided and that are provided on both sides of the middle part, and a width of the middle part may be larger than a width of the connecting part.

The charging part may be formed by extending the positive electrode and the negative electrode formed in the bent portions toward an upstream side of the dust collecting part.

The charging part may include a discharge electrode and a correspondence electrode, the discharge electrode may be formed in a strip shape at one side of the positive electrode or the negative electrode and provided inside the insulating sheet, one end of the discharge electrode may be exposed to an outside of the insulating sheet, and the correspondence electrode may have a polarity opposite to that of the discharge electrode and may be extended from one side of the negative electrode or the positive electrode.

The length of the discharge electrode may be at least five times the width of the discharge electrode.

The correspondence electrode may be provided inside the insulating sheet.

The one end of the discharge electrode exposed to the outside of the insulating sheet may be formed to be located downstream in the air moving direction.

According to another aspect of the present invention, a method of manufacturing an electric dust collection device may include forming first negative electrodes on one surface of a base film continuously supplied; forming positive electrodes on an opposite surface of the base film so as to be spaced apart from the first negative electrodes by predetermined distances; attaching a cover film continuously supplied to the opposite surface of the base film; forming second negative electrodes at positions facing the first negative electrodes of the base film on a surface of the cover film; forming gap holding members on the surface of the cover film in a moving direction of the cover film; forming openings or slits penetrating the base film and the cover film between the second negative electrodes and the positive electrodes; and bending the base film to which the cover film is attached with respect to the openings or the slits.

A width of the cover film may be smaller than a width of the base film, and one side of the cover film may be aligned with one side of the base film.

DETAILED DESCRIPTION

Hereinafter, embodiments of an electric dust collection device according to an embodiment of the present invention and a method of manufacturing the same will be described in detail with reference to the accompanying drawings.

It is to be understood that the embodiments described below are provided for illustrative purpose only, and that the present disclosure may be embodied with various modifications different form exemplary embodiments described herein. However, in the following description below, detailed description of well-known functions or components will be omitted when it may be unnecessary to obscure the subject matter of the present disclosure. Further, the accompanying drawings may be not drawn to scale in order to facilitate understanding of the invention, but the dimensions of some of the components may be exaggerated.

In the following description, an electrode having a high level potential is represented as a positive electrode and an electrode having a low level potential is represented as a negative electrode based on the potential difference between two electrodes.

Figure 1:
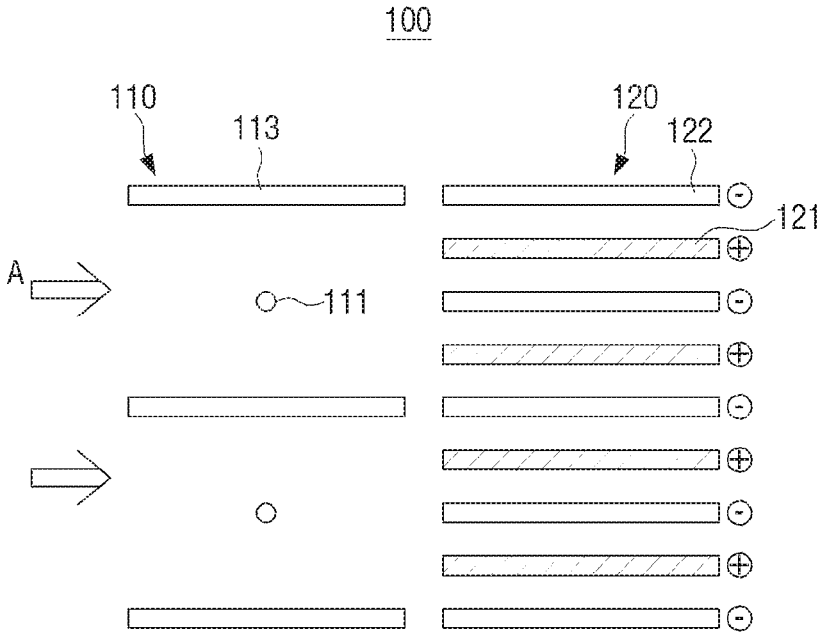
FIG. 1 (PRIOR ART)
FIG. 1 is a conceptual diagram of a conventional electric dust collection device.
Figure 2:
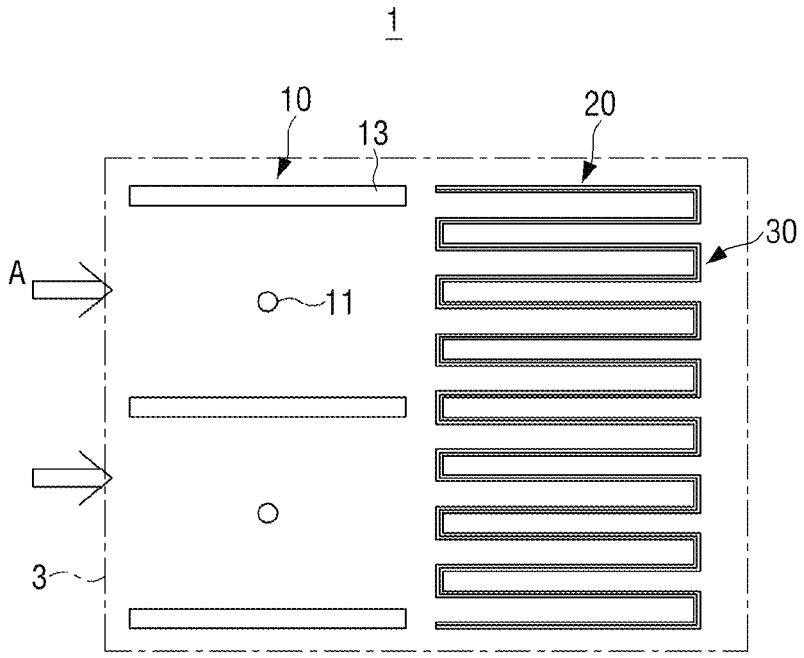
FIG. 2 is a view conceptually illustrating an electric dust collection device according to an embodiment of the present invention.
Figure 3A:
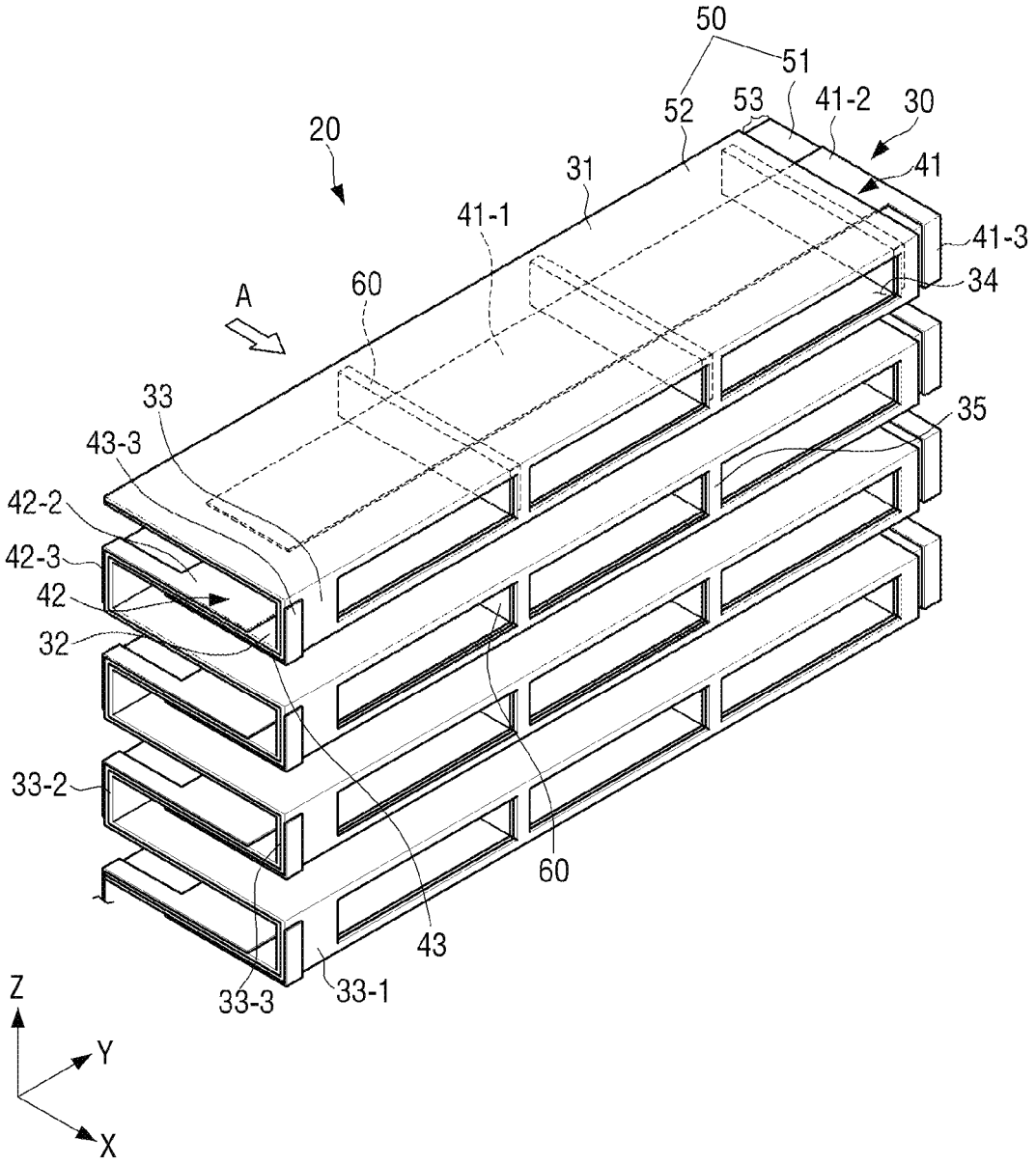
FIG. 3*a* is a perspective view illustrating a dust collecting member used in an electric dust collection device according to an embodiment of the present invention.
Figure 3B:
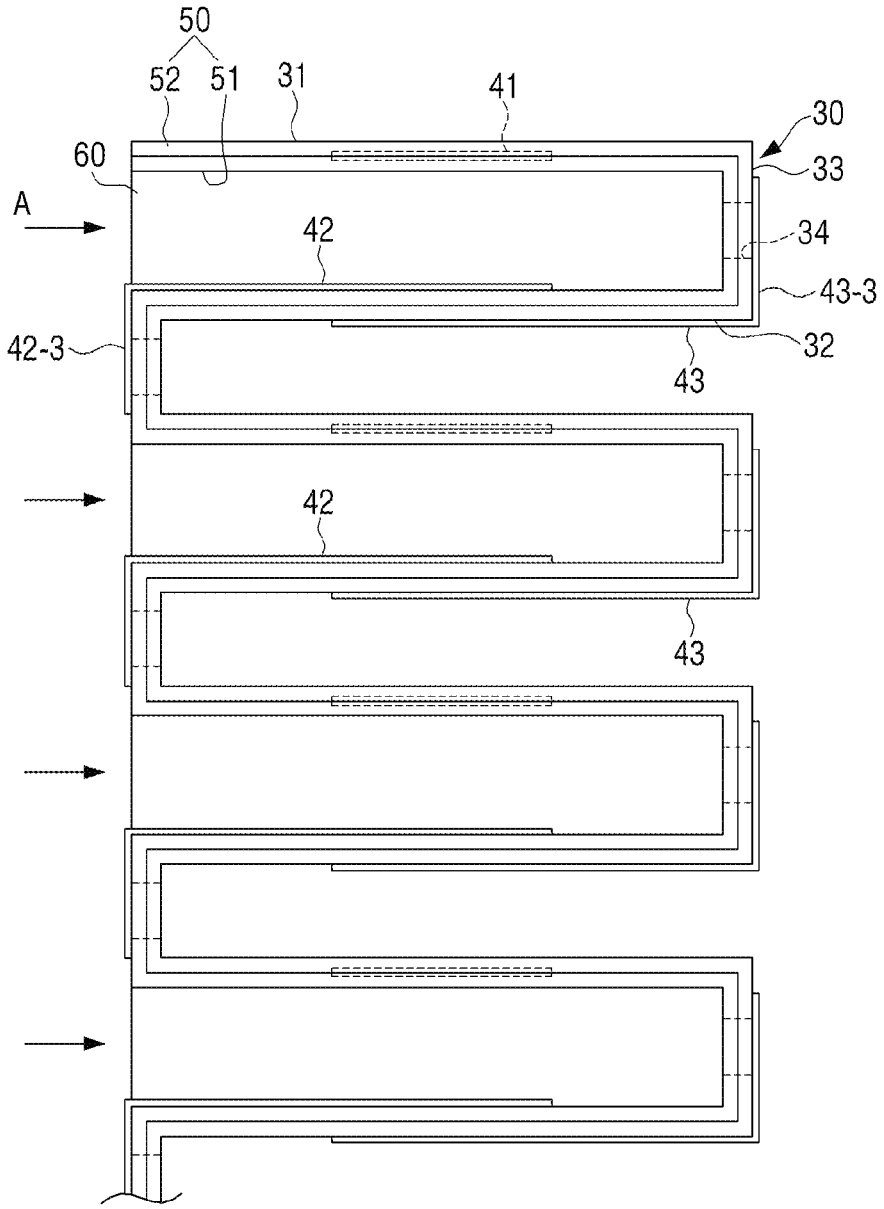
FIG. 3*b* is a side view of the dust collecting member of FIG. 3*a;*
Figure 4A:
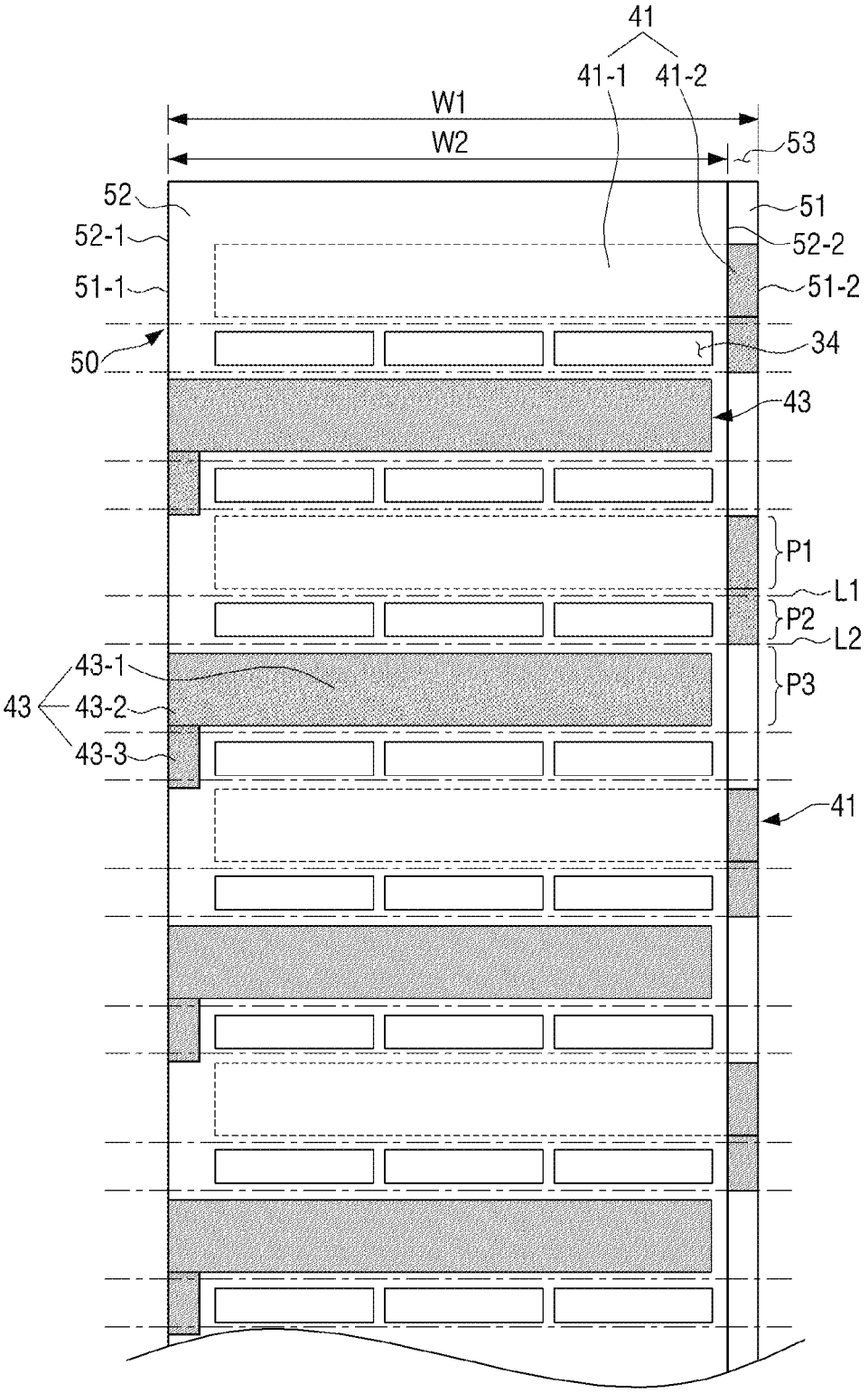
FIG. 4*a* is a view illustrating a state in which the dust collecting member of FIG. 3*a* is unfolded.
Figure 4B:
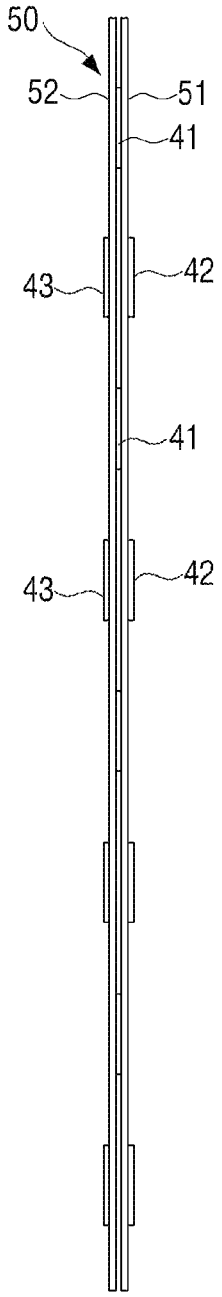
FIG. 4*b* is a side view of the dust collecting member of FIG. 4*a;*

FIG. 2 is a view conceptually illustrating an electric dust collection device according to an embodiment of the present invention. FIG. 3*a* is a perspective view illustrating a dust collecting member used in an electric dust collection device according to an embodiment of the present invention, and FIG. 3*b* is a side view of the dust collecting member of FIG. 3*a*. FIG. 4*a* is a view illustrating a state in which the dust collecting member of FIG. 3*a* is unfolded, and FIG. 4*b* is a side view of the dust collecting member of FIG. 4*a*.

Referring to FIG. 2, an electric dust collection device 1 according to an embodiment of the present invention may include a charging part 10 and a dust collecting part 20. The charging part 10 and the dust collecting part 20 are provided in a housing 3. A fan (not illustrated) is provided in front of the charging part 10 and blows air toward the charging part. Therefore, the outside air passes through the charging part 10, passes through the dust collecting part 20, and is discharged to the outside. The electric dust collection device 1 according to an embodiment of the present invention may be implemented as an air cleaner or an air conditioner having an air cleaning function.

The charging part 10 is for charging dust, and may include a plurality of discharge electrodes 11 and a plurality of correspondence electrodes 13. Two correspondence electrodes 13 are provided on the upper and lower sides of one discharge electrode 11 at a predetermined interval. Therefore, when a predetermined voltage is applied to the discharge electrode 11 and the correspondence electrodes 13, a corona discharge may occur between one discharge electrode 11 and the two correspondence electrodes 13. The discharge electrode 11 may be formed in a wire electrode. The discharge electrode 11 may be made of tungsten wire. Each of the correspondence electrodes 13 is formed in a flat plate shape and may be formed of a conductive metal plate. For example, the correspondence electrodes 13 may be formed of an aluminum plate.

The dust collecting part 20 is for removing the dust charged in the charging part 10 and may be embodied as a dust collecting member formed by continuously bending an insulating sheet 50 having a long length.

Referring to FIGS. 2, 3*a* and 3*b*, the dust collecting member 20 includes a plurality of bent portions 30 formed by continuously bending the insulating sheet 50 having a long length in a shape of a substantially square wave. The plurality of bent portions 30 are disposed to face a region between the pair of correspondence electrodes 13 of the charging part 10. For example, the dust collecting member 20 may be formed such that ten bent portions 30 face the region between the pair of the correspondence electrodes 13.

Each of the plurality of bent portions 30 includes two planes 31 and 32 facing each other at a predetermined interval and a connecting wall 33 connecting respective one ends of the two planes 31 and 32 in the vertical direction. The two planes 31 and 32 are formed to have the same size. The connecting wall 33 is provided with an opening 34 through which air passes. The connecting walls 33 are arranged alternately in the left and the right in the height direction of the dust collecting member 20. In detail, when the connecting wall 33-1 of the bent portion 30 at the bottom end is located on the right side, the connecting wall 33-2 of the next bent portion 30 is located on the left side, and the connecting wall 33-3 of the one after the next is located on the right side again.

A positive electrode 41 is formed on one plane 31 of the two planes 31 and 32 constituting the bent portion 30 and a negative electrode 42 is formed on the other plane 32 facing the one plane 31. The positive electrode 41 and the negative electrode 42 may be formed by printing or depositing a conductive material on the surface of the insulating sheet 50. For example, the positive electrode and the negative electrode may be printed on the surface of the insulating sheet 50 with carbon ink or silver-containing paint. Alternatively, aluminum may be deposited on the surface of the insulating sheet 50 to form the positive electrode 41 and the negative electrode 42.

The insulating sheet 50 constituting the bent portions 30 of the dust collecting member 20 may be formed by overlapping two insulating films 51 and 52. For example, the insulating sheet 50 may be embodied by a base film 51 and a cover film 52 which are overlapped with each other. The base film 51 and the cover film 52 are insulating films. At this time, the width W2 of the cover film 52 is formed to be smaller than the width W1 of the base film 51. Therefore, when the base film 51 and the cover film 52 are overlapped with each other so that one side 51-1 of the base film 51 and one side 52-1 of the cover film 52 are aligned with each other, the top surface near the other side 51-2 of the base film 51 becomes an exposed portion 53 that is exposed without being covered by the cover film 52. Hereinafter, the one side of the base film where the base film and the cover film coincide with each other is referred to as the first side 51-1 of the base film and the other side of the base film where the exposed portion 53 is formed is referred to as the second side 51-2.

One of the two electrodes facing each other is disposed inside the insulating sheet 50 so as not to be exposed to the outside of the insulating sheet 50. In the case of the present embodiment, one of the positive electrode 41 and the negative electrode 42 is formed between the base film 51 and the cover film 52. Hereinafter, for convenience of explanation, the electrode provided inside the insulating sheet 50, that is, between the base film 51 and the cover film 52 is referred to as the positive electrode 41, and the electrode exposed to the outside of the base film 51 or the cover film 52 is referred to as the negative electrode 42. Therefore, as another example, the negative electrode 42 may be formed inside the insulating sheet 50, that is, between the base film 51 and the cover film 52, and the positive electrode 41 may be formed to be exposed to the outside of the base film 51 or the cover film 52.

The positive electrode 41 provided inside the insulating sheet 50 is formed in a substantially rectangular shape from the second side 51-2 of the base film 51 toward the first side 51-1 of the base film 51. The positive electrode 41 is formed to be spaced apart from the first side of the base film 51 by a predetermined distance. A portion of the positive electrode 41 is exposed to the outside because the exposed portion 53 without the cover film 52 is provided near the second side 51-2 of the base film 51. The portion 41-2 of the positive electrode 41 exposed to the outside functions as a power supply part for supplying power to the positive electrode 41. The exposed portion of the positive electrode 41 may be extended to the connecting wall 33 of the bent portion as illustrated in FIG. 3*a*. Therefore, when external electrodes are connected to the extended portions 41-3 of the positive electrodes 41 extended to the connecting walls 33 of the plurality of bent portions 30, the same electrical power may be supplied to the plurality of positive electrodes 41 formed on the plurality of bent portions 30.

The negative electrodes 42 and 43 provided on the outer surface of the insulating sheet 50 are formed in a substantially rectangular shape from the first side 51-1 of the base film 51 toward the second side of the base film 51. Two negative electrodes 42 and 43 are formed on the top and bottom surfaces of the insulating sheet 50 at positions corresponding to each other. In detail, first negative electrodes 42 are formed on the bottom surface of the base film 51, and second negative electrodes 43 are formed on the surface of the cover film 52 to correspond to the first negative electrodes 42.

The portion 42-2 of the first negative electrode 42 adjacent to the first side 51-1 of the base film 51 is formed to be extended to the connecting wall 33 with a predetermined width as illustrated in FIG. 3*a*. The extended portion 42-3 of the negative electrode 42 is located on the opposite side of the extended portion 41-3 of the positive electrode 41 with the openings 34 of the connecting wall 33 interposed therebetween. Accordingly, when the external electrodes are connected to the negative electrodes 42 and 43 extended to the connecting walls 33 of the plurality of bent portions 30, the same electric power may be supplied to the plurality of negative electrodes 42 and 43 formed on the plurality of bent portions 30. At this time, in FIG. 3*a*, the external electrodes for supplying power to the plurality of negative electrodes 43 extended to the connecting walls 33 located on the right side of the dust collecting member 20 and the external electrodes for supplying power to the plurality of negative electrodes 42 extended to the connecting walls 33 located on the left side of the dust collecting member 20 are required.

The above-described dust collecting member 20 may be formed by alternately forming the positive electrodes 41 and the negative electrodes 42 and 43 on the insulating sheet 50, spacing the positive electrodes 41 and the negative electrodes 42 and 43 at predetermined intervals, forming the openings 34 passing through the insulating sheet 50 between the positive electrodes 41 and the negative electrodes 42 and 43, and then folding the insulating sheet 50 with respect to the openings 34.

A planar figure of the dust collecting member is illustrated in FIG. 4*a*, and a side view of the dust collecting member 20 of FIG. 4*a* is illustrated in FIG. 4*b*.

Referring to FIGS. 4*a* and 4*b*, the plurality of positive electrodes 41 are formed at predetermined intervals on the top surface of the base film 51, and the cover film 52 is superimposed on the base film 51 over the plurality of positive electrodes 41. At this time, since the width W2 of the cover film 52 is smaller than the width W1 of the base film 51, a portion of the right side of the base film 51 is not covered with the cover film 52, and a portion of the positive electrode 41 is exposed to the outside. However, most of the positive electrode 41-1 serving as the electric field forming portion is located between the base film 51 and the cover film 52 and is not exposed to the outside. The portion 41-2 of the positive electrode 41 exposed to the outside functions as a power connection part.

On the top surface of the cover film 52, the plurality of second negative electrodes 43 are formed between the plurality of positive electrodes 41. On the bottom surface of the base film 51, the plurality of first negative electrodes 42 are formed at positions corresponding to the plurality of second negative electrodes 43. Therefore, the positive electrodes 41 and the negative electrodes 42 and 43 are alternately formed in the longitudinal direction of the insulating sheet 50. The portions 42-1 and 43-1 of the first and second negative electrodes 42 and 43 corresponding to the positive electrodes 41 function as electric field forming portions together with the positive electrodes 41, and the end portions 42-2 and 43-2 of the first and second negative electrodes 42 and 43 which do not correspond to the positive electrodes 41 function as power connection parts for supplying power.

The positive electrode 41 and the first negative electrode 42 are spaced apart from each other by a predetermined distance and the openings 34 penetrating the cover film 52 and the base film 51 is formed therebetween.

The alternated long and short dash line between the positive electrode 41 and the openings 34 is a first folding line L1 and the alternated long and short dash line between the negative electrode 43 and the openings 34 is a second folding line L2. Therefore, the first part P1 having the positive electrode 41 is folded along the first folding line L1 at 90 degrees with respect to the second part P2 having the openings 34, and then the third part P3 having the negative electrode 43 is folded along the second folding line L2 at 90 degrees with respect to the second part P2 having the openings 34 to face the first part P1 in parallel, so that the bent portion 30 forming the dust collecting member 20 is formed. In other words, the first part P1 and the third part P3 are two planes 31 and 32 facing each other in parallel, and the second part P2 is the connecting wall 33 connecting the two planes 31 and 32. When the portions on which the positive electrodes 41 are formed and the portions on which the negative electrodes 42 and 43 are formed are successively folded with respect to the portions P2 on which the openings 34 are formed as described above, the dust collecting member 20 according to an embodiment of the present invention may be formed.

A gap holding member 60 is provided between the two planes 31 and 32 of the bent portion 30 to keep the gap G between the two planes 31 and 32 constant. In order to form a constant electric field between the positive electrode 41 and the negative electrodes 42 and 43 formed on the two facing planes 31 and 32 of the bent portions 30 and to allow air to flow uniformly between the positive electrode 41 and the negative electrodes 42 and 43, it is necessary to keep the gap between the two planes 31 and 32 constant.

However, the gap holding member 60 may interfere with the air passing between the two planes 31 and 32 and the formation of an electric field between the two planes 31 and 32. Therefore, the gap holding member 60 may be formed to have a uniform and narrow width as much as possible so that the gap holding member 60 can minimize interference with air flow and electric field formation. A plurality of gap holding members 60 may be provided at predetermined intervals in the longitudinal direction (Y direction) of the dust collecting member 20. In the present embodiment, as illustrated in FIG. 3*a*, two gap holding members 60 are provided in straight lines with two columns 35 between the three openings 34 formed in the connecting wall 33 in the air flow direction (arrow A).

The gap holding members 60 may be formed by any of a variety of methods as long as they can maintain the gap G between the two planes 31 and 32 constituting the bent portion 30 and minimize the interference with air flow and electric field formation.

When the dust collecting member 20 is formed by bending the single insulating sheet 50 as in the present invention, the gap holding members 60 may be continuously formed on one surface of the unfolded insulating sheet 50 before the insulating sheet 50 is bent. In this case, the heights of the gap holding members 60 may be determined such that the sum of the heights of the two gap holding members contacting each other when the bent portion 30 is formed by folding the insulating sheet 50 becomes equal to the gap between the two planes 31 and 32. For example, in the case in which the gap holding members having a height of ½ of the gap between the two planes of the bent portion are formed on the top surface of the unfolded insulating sheet, when the insulating sheet is bent, the two planes forming the bent portion are supported by the two gap holding members so that the two planes are held constant at a desired gap.

The gap holding member 60 may be formed on the insulating sheet 50 to have a predetermined width and height with a thermally fusible adhesive such as hot melt. Alternatively, the gap holding member 60 may be formed by attaching a double-sided tape having a predetermined width and height to the insulating sheet 50.

In the above description, the gap holding member 60 is formed over the entire width direction (X direction) of the two facing planes 31 and 32 of the bent portion 30. However, the gap holding member 60 may be formed in a spot shape to minimize the interference of the gap holding member 60 with respect to the air flow and the electric field. At this time, the spot-shaped gap holding members may be formed in a spot shape at one end of the dust collecting member 20 adjacent to the charging part and the other end thereof adjacent to the opening in the width direction of the dust collecting member 20 (see FIG. 5).

Figure 15A:
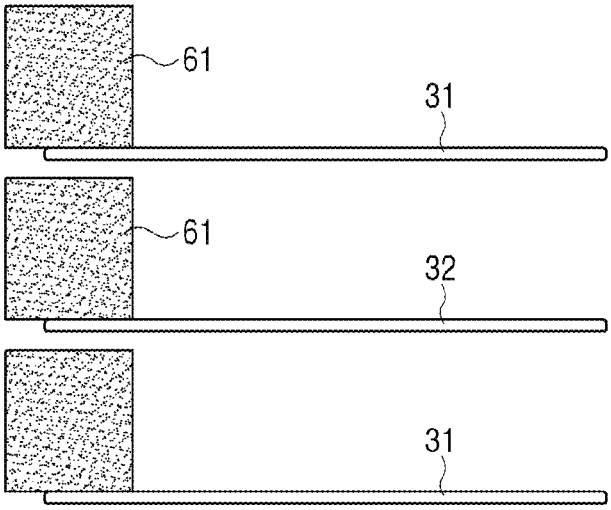
FIG. 15*a* is a view illustrating another example of gap holding members used in a dust collecting member of an electric dust collection device according to an embodiment of the present invention.
Figure 15B:
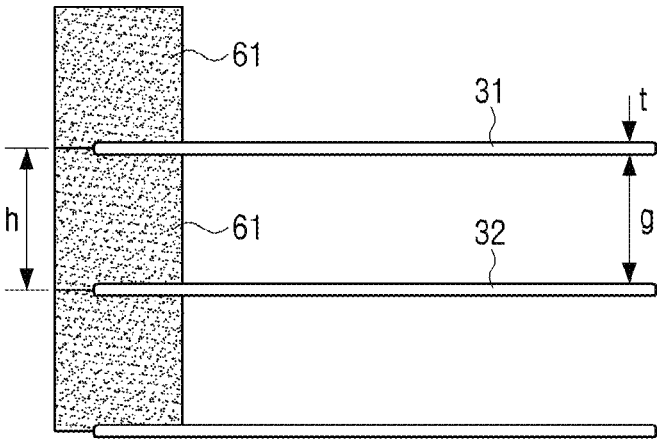
FIG. 15*b* is a view illustrating a case where adjacent insulating sheets are fixed by the gap holding members of FIG. 15*a;*

As another embodiment, the gap holding member 60 may be formed of an elastic conductive material. At this time, as illustrated in FIG. 15*b*, a conductive gap holding member 61 is formed so that the height of the conductive gap holding member 61 is higher than the gap g between the two planes 31 and 32 of the bent portion by the thickness t of each of the planes 31 and 32, that is, the thickness of the insulating sheet. The conductive gap holding member 61 may be provided such that a portion of the conductive gap holding member 61 protrudes outward from respective one ends of the two planes 31 and 32 of the bent portion. When the two planes 31 and 32 are supported by the conductive gap holding member 61 as illustrated in FIG. 15*b*, the protruding portions of the two conductive gap holding members 61 which are positioned above and below may be brought into contact and electrically connected with each other. At this time, the two gap holding members 60 may be bonded with a conductive adhesive.

The operation of the electric dust collection device 1 according to an embodiment of the present invention having the above-described structure will be described.

When a voltage of several KV is applied to the wire electrode 11 of the charging part 10, a corona discharge is generated between the wire electrode 11 and the correspondence electrodes 13 having a flat plate shape.

In this state, when air containing dust is introduced into the charging part 10 by a fan (not illustrated), the dust is charged to have a positive (+) polarity while passing through the charging part 10.

The dust charged with the positive polarity passes through between the two planes 31 and 32 provided in the plurality of bent portions 30 of the dust collecting member 20 according to the present invention together with the air. At this time, when the voltage is applied to the power connection parts of the dust collecting member 20 according to the present invention, that is, the power connection parts of the plurality of positive electrodes 41 and the power connection parts of the plurality of negative electrodes 42 and 43, electric fields are formed between the positive electrodes 41 and the negative electrodes 42 and 43 and the dust passing through the dust collecting member 20 is adhered to the negative electrodes 42 and 43 by the electric fields. Therefore, while the outside air passes through the dust collecting member 20, the dust is removed and only the clean air is discharged to the outside.

When the amount of dust adhered to the dust collecting member 20 increases with prolonged use, the dust collecting efficiency is lowered. In this case, the dust collecting member 20 is cleaned and reused so that the dust collecting efficiency of the dust collecting member 20 is improved again.

Figure 5:
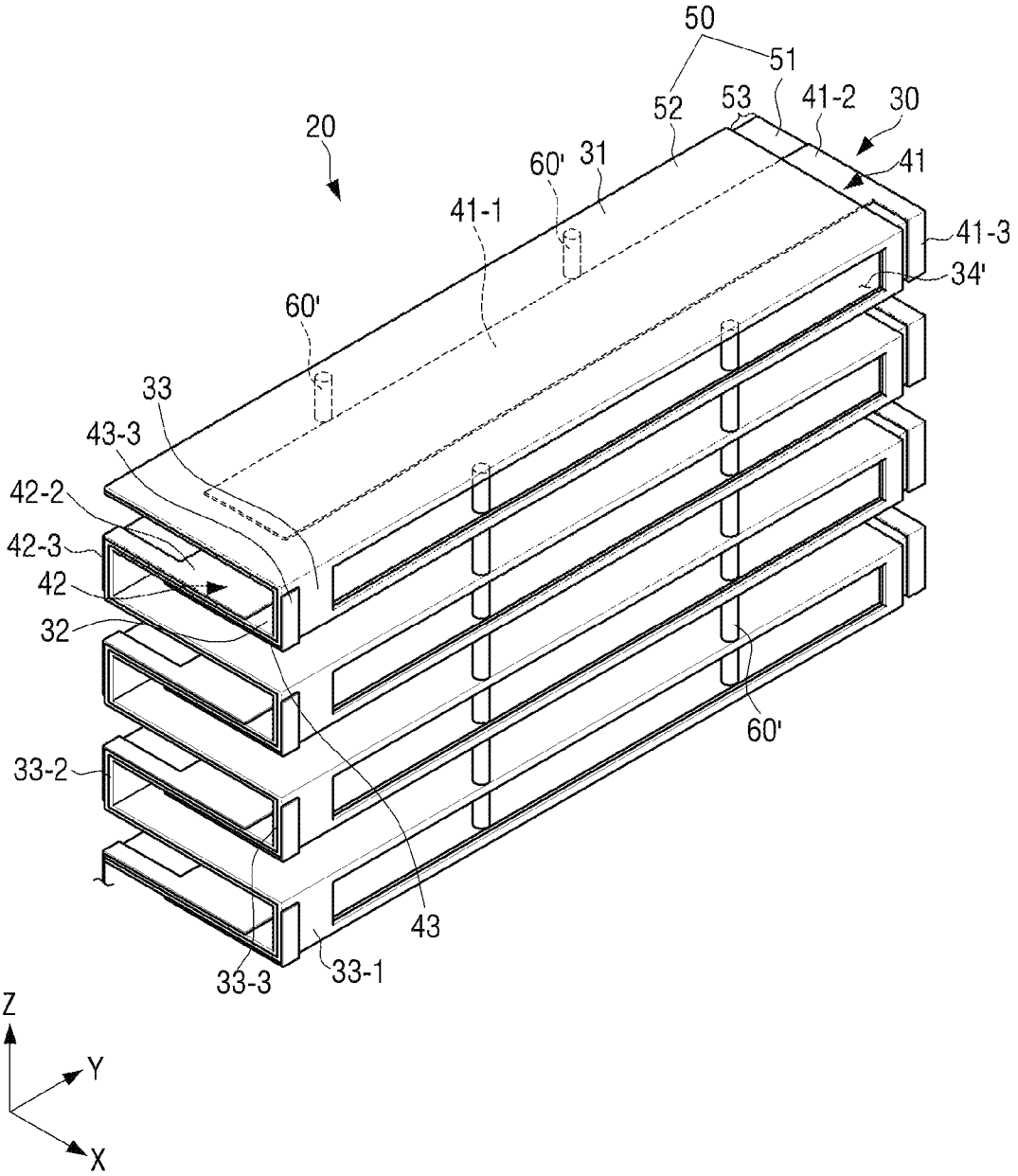
FIG. 5 is a perspective view illustrating another example of a dust collecting member of an electric dust collection device according to an embodiment of the present invention.

FIG. 5 is a perspective view illustrating a modified example of a dust collecting member of an electric dust collection device according to an embodiment of the present invention.

The dust collecting member 20 illustrated in FIG. 5 differs from the dust collecting member 20 illustrated in FIG. 2*a* in the shape of the opening 34' formed in the connecting wall 33. There is a difference in that three openings 34 are formed in the connecting wall 33 of the dust collecting member 20 illustrated in FIG. 2*a*, but only one opening 34' is formed in the connecting wall 33 of the dust collecting member 20 illustrated in FIG. 5. Further, in the dust collecting member 20 of FIG. 5, spot-shaped gap holding members 60' are provided near both ends of the two planes 31 and 32 between the two planes 31 and 32 in the width direction (X direction) of the dust collecting member 20. The other structures are the same as those of the above-described dust collecting member 20, and therefore detailed description thereof is omitted.

Figure 6A:
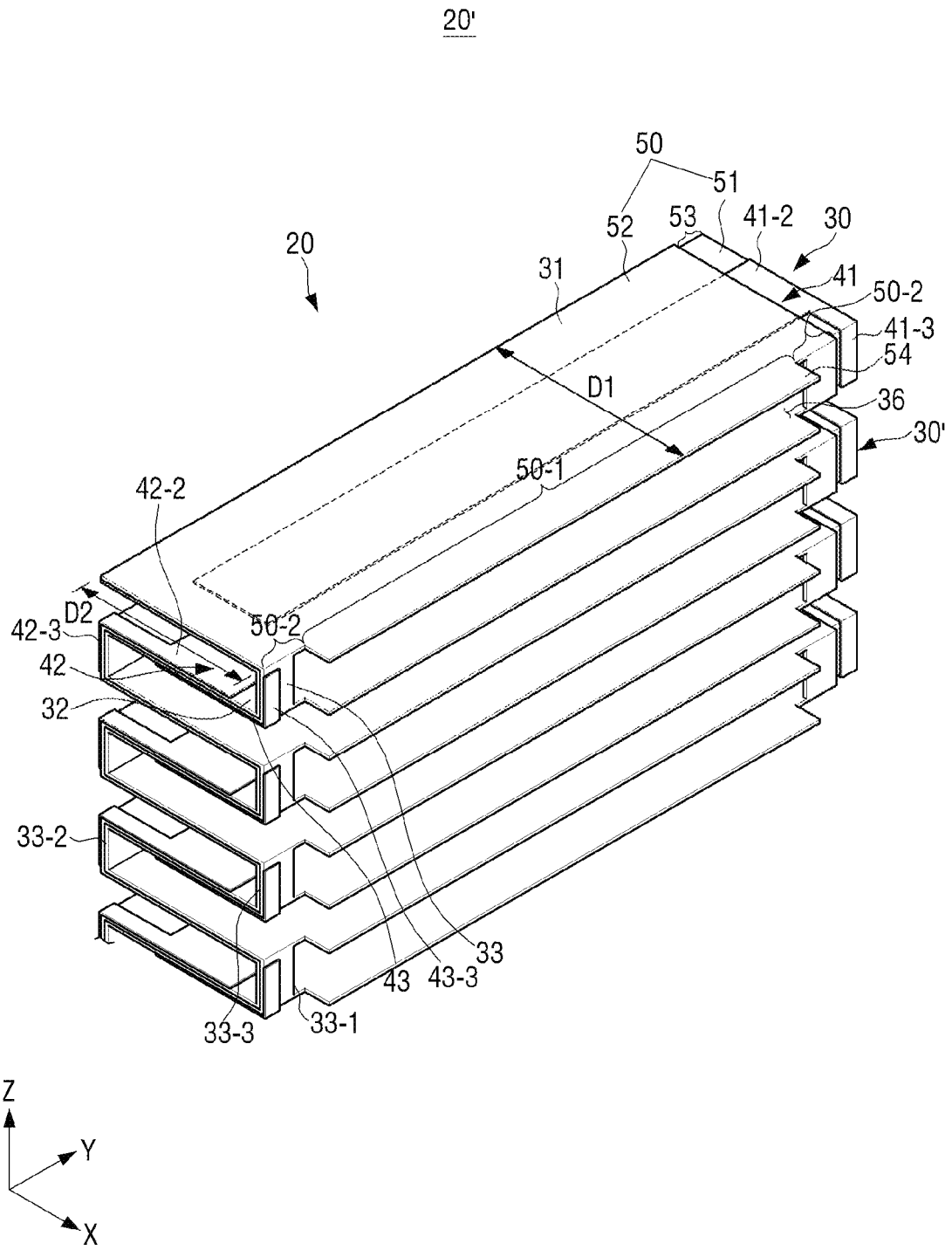
FIG. 6*a* is a perspective view illustrating another example of a dust collecting member of an electric dust collection device according to an embodiment of the present invention.
Figure 6B:
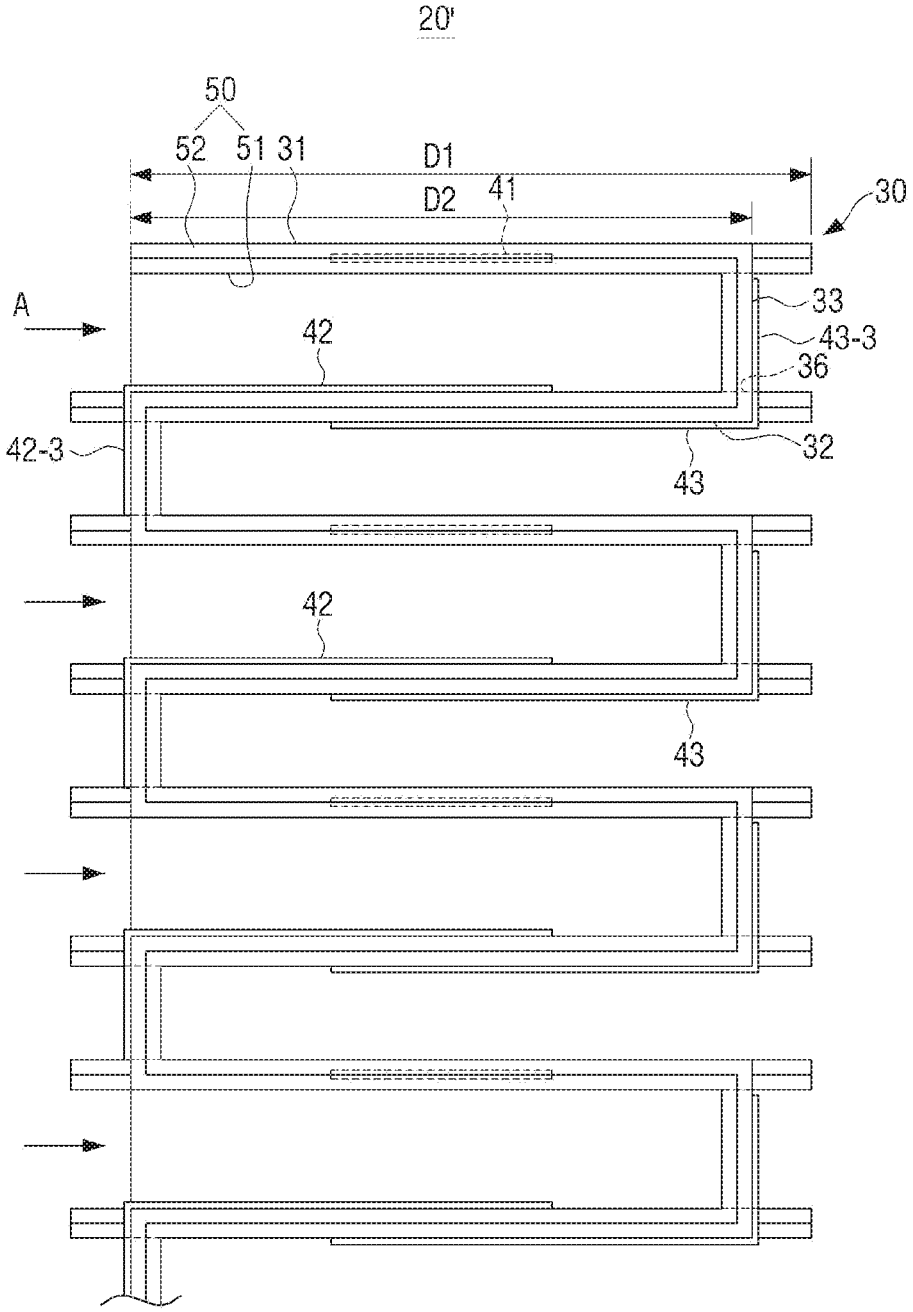
FIG. 6*b* is a side view of the dust collecting member of FIG. 6*a;*
Figure 7:
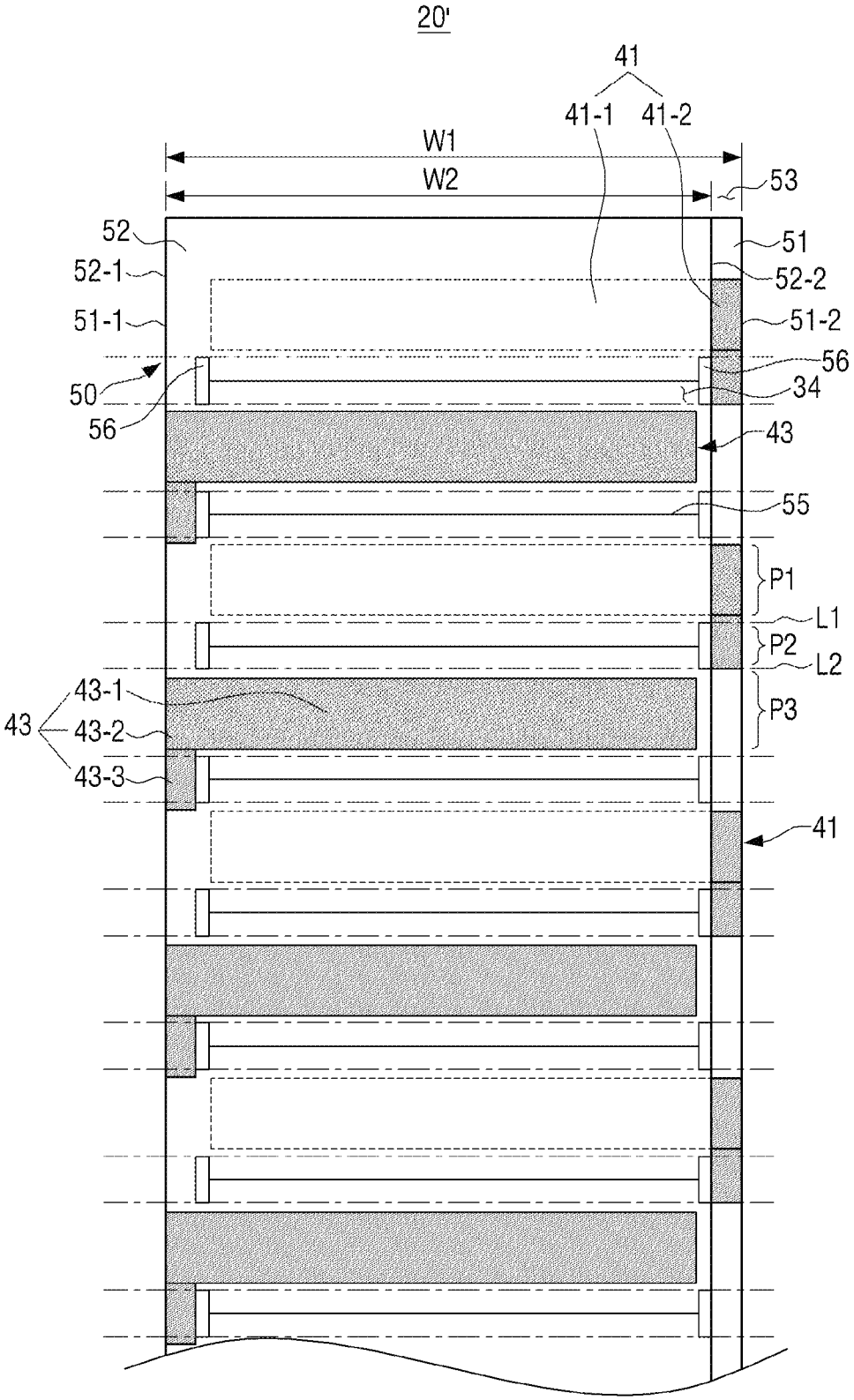
FIG. 7 is a view illustrating a state in which the dust collecting member of FIG. 6*a* is unfolded.

FIG. 6*a* is a perspective view illustrating another example of a dust collecting member of an electric dust collection device according to an embodiment of the present invention, and FIG. 6*b* is a side view of the dust collecting member of FIG. 6*a*. FIG. 7 is a view illustrating a state in which the dust collecting member of FIG. 6*a* is unfolded.

Referring to FIGS. 6*a* and 6*b*, the dust collecting member 20' in different from the dust collecting member 20 of the electric dust collection device according to the above-described embodiment in that a portion of the plane of the bent portion 30' corresponding to the opening 36 of the connecting wall 33 has a protruding part 54 protruding outward from the connecting wall 33.

In detail, each of the two planes 31 and 32 of the bent portions 30' include a middle portion 50-1 in which the electric field forming portion of the negative electrode 42 or the positive electrode 41 is formed and that is located above or below the opening 36 and connecting portions 50-2 in which the power connection part of the negative electrode 42 or the positive electrode 41 is provided and that are provided on both sides of the middle portion 50-1. At this time, in the case of the dust collecting member 20 as illustrated in FIGS. 2*a* and 2*b*, the widths of the middle portion and the connecting portions of the plane of the bent portion 30 are the same. However, in the case of the present embodiment as illustrated in FIGS. 6*a* and 6*b*, the width D1 of the middle portion 50-1 of the plane 31 of the bent portion 30' is wider than the width D2 of the connecting portions 50-2.

The dust collecting member 20' having such a structure may be formed by processing and bending the insulating sheet 50 as illustrated in FIG. 7.

Referring to FIG. 7, a plurality of positive electrodes 41 are formed at predetermined intervals on the top surface of the base film 51, and the cover film 52 is overlapped on the plurality of positive electrodes 41. At this time, since the width W2 of the cover film 52 is smaller than the width W1 of the base film 51, the part of the right side of the base film 51 is not covered with the cover film 52 so that a part of the positive electrode 41 is exposed to the outside. However, the majority 41-1 of the positive electrode 41 forming the electric field forming portion is located between the base film 51 and the cover film 52 and is not exposed to the outside. The part of the positive electrode 41 exposed to the outside functions as a power connection part.

On the top surface of the cover film 52, a plurality of second negative electrodes 43 are formed between the plurality of positive electrodes 41. A plurality of first negative electrodes 42 are formed on the bottom surface of the base film 51 at positions corresponding to the plurality of second negative electrodes 43. Therefore, the positive electrodes 41 and the negative electrodes 43 are alternately formed in the longitudinal direction of the insulating sheet 50.

The positive electrode 41 and the second negative electrode 43 are separated from each other by a predetermined distance and a slit 55 cut the cover film 52 and the base film 51 is formed therebetween. At both ends of the slit 55, rectangular through holes 56 having the same height as the height of the connecting wall 33 of the bent portion 30' are formed. The two through holes 56 are formed to penetrate the insulating sheet 50, that is, the cover film 52 and the base film 51. A part of the exposed positive electrode 41 is extended to a side of one through hole 56, and a part of the negative electrode 42 is extended to a side of the other through hole 56. The part of the positive electrode 41 and the parts of the negative electrodes 42 and 43 extended to the side of each of the through holes 56 form contact points to which external power is supplied.

In FIG. 7, two alternated long and short dash lines L1 and L2 connecting the upper and lower ends of the two through holes 56 serve as lines for folding the insulating sheet 50. Accordingly, the first part P1 having the positive electrode is folded along the first folding line L1 connecting the upper ends of the two through holes 56 at 90 degrees with respect to the second part P2 where the through holes 56 are formed, and then the third part P3 having the negative electrode is folded along the second folding line L2 connecting the lower ends of the two through holes 56 at 90 degrees with respect to the second part P2 so as to face the first part P1 in parallel, so that the bent portions 30' forming the dust collecting member 20' are formed. In other words, the first part P1 and the third part P3 are two planes 31 and 32 facing each other in parallel, and the second part P2 is the connecting wall 33 connecting the two planes 31 and 32. At this time, the portion of the insulating sheet 50 cut by the slit 50 protrudes to the outside from the connecting wall 33, and the two through holes 56 are connected to form an opening 36 through which air passes.

When the dust collecting member 20' is formed with such a structure, the portions of the insulating sheet 50 where the openings are formed may not be used. Therefore, the amount of the insulating sheet 50 that forms the dust collecting member may be reduced compared to the dust collecting member 20 of FIGS. 2*a* and 2*b* as described above.

In the above description, the charging part and the dust collecting part are separately formed. However, the charging part may be formed integrally with the dust collecting part. Hereinafter, an electric dust collection device in which a charging part and a dust collecting part are integrally formed will be described with reference to FIGS. 8 to 11 attached thereto.

Figure 8:
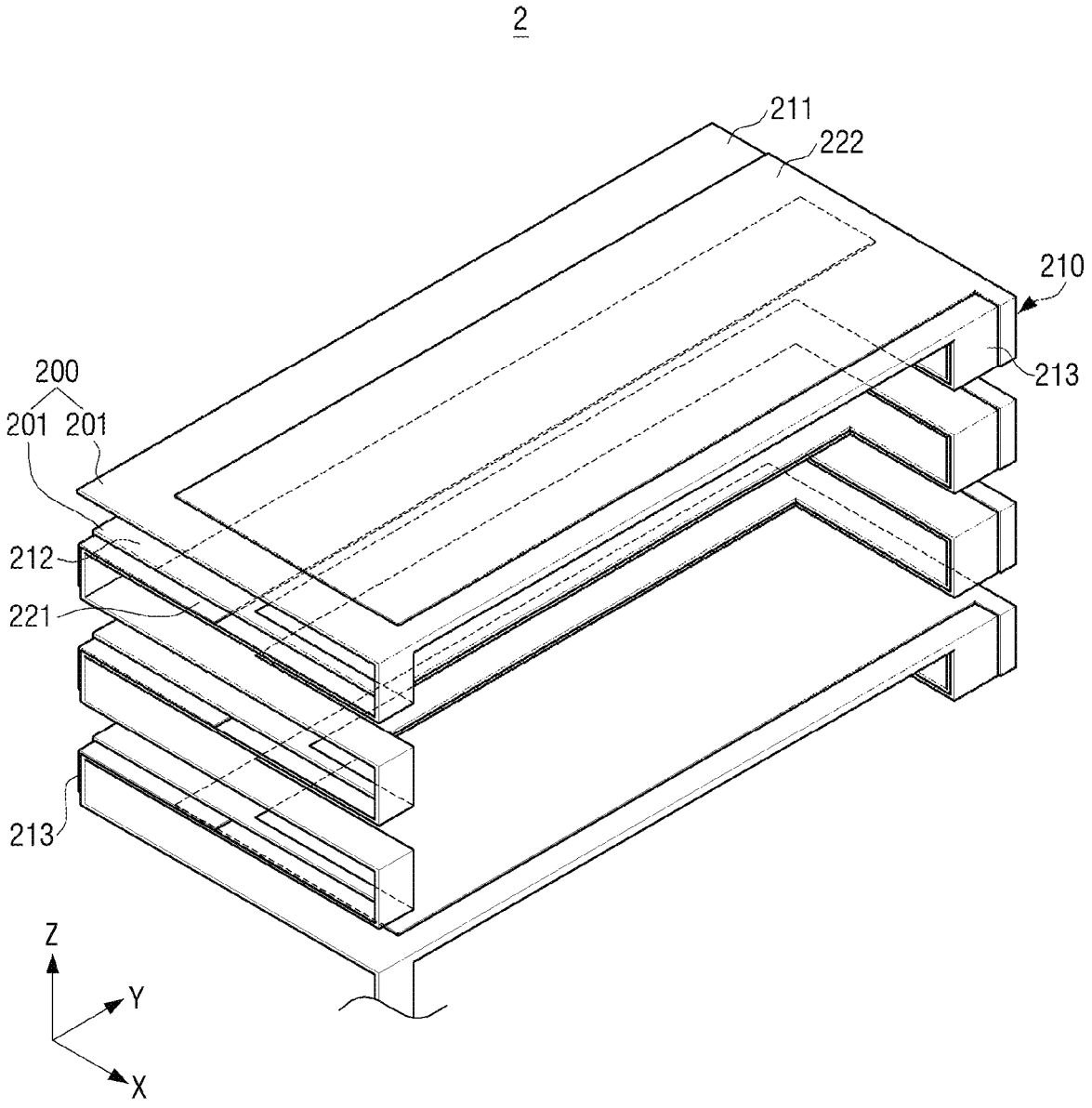
FIG. 8 is a perspective view illustrating an electric dust collection device according to another embodiment of the present invention.
Figure 9:
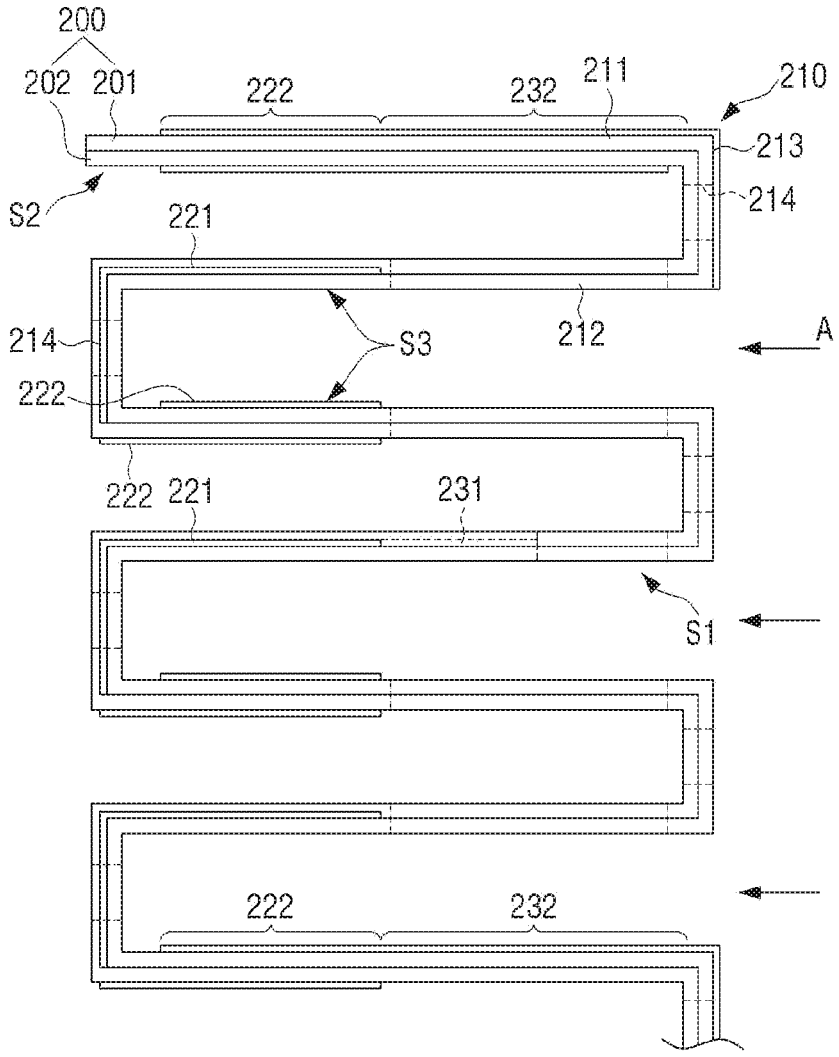
FIG. 9 is a side view of the electric dust collection device of FIG. 8.
Figure 10:
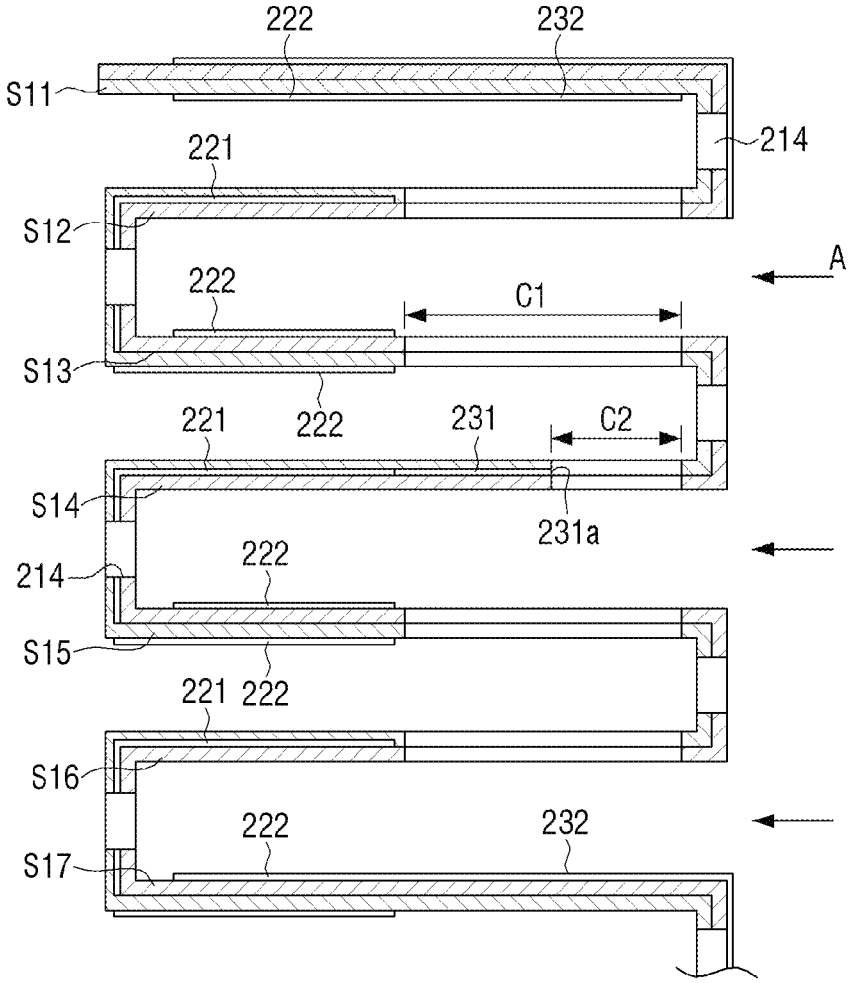
FIG. 10 is a cross-sectional view illustrating the electric dust collection device of FIG. 8 taken along a line 10-10.
Figure 11:
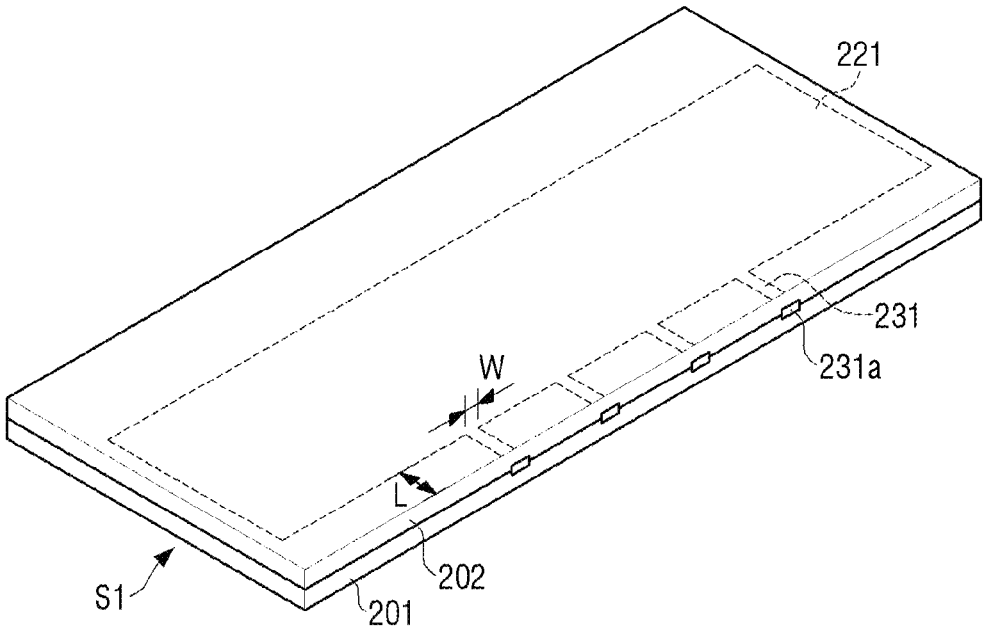
FIG. 11 is a perspective view illustrating a plane of a bent portion where a discharge electrode is formed in the electric dust collection device of FIG. 8.

FIG. 8 is a perspective view illustrating an electric dust collection device according to another embodiment of the present invention. FIG. 9 is a side view of the electric dust collection device of FIG. 8, and FIG. 10 is a cross-sectional view illustrating the electric dust collection device of FIG. 8 taken along a line 10-10. FIG. 11 is a perspective view illustrating one plane of a bent portion where a discharge electrode is formed in the electric dust collection device of FIG. 8.

Referring to FIGS. 8 to 10, an electric dust collection device 2 according to an embodiment of the present disclosure may include a plurality of bent portions 210 formed by continuously bending a single long insulating sheet 200. The insulating sheet 200 may be formed of two insulating films, that is, a base film 201 and a cover film 202, like the dust collecting member 20 according to the above-described embodiment.

Each of the plurality of bent portions 210 includes two planes 211 and 212 facing each other at a predetermined gap and a connecting wall 213 connecting respective one ends of the two planes 211 and 212 in the vertical direction. The two planes 211 and 212 are formed to have the same size. The connecting wall 213 is provided with an opening 214 through which air passes. The connecting walls 213 are arranged alternately in the left and the right in the height direction (Z direction) of the electric dust collection device 2. For example, when the connecting wall 213 of the bent portion 210 at the bottom end is located on the left side, the connecting wall 213 of the next bent portion 210 is located on the right side, and the connecting wall 213 of the one after the next is located on the left side again.

A positive electrode 221 is formed on one of the two planes 211 and 212 constituting the plurality of bent portions 210 and a negative electrode 222 is formed on the other plane facing the one plane. At this time, the positive electrode 221 is formed between the base film 201 and the cover film 202, and the negative electrode 222 is formed on the outer surfaces of the base film 201 and the cover film 202.

In the case of the present embodiment, the plurality of planes constituting the plurality of bent portions 210 include three kinds of planes. Referring to FIG. 9, the plurality of planes include a discharge plane S1 on which a discharge electrode 231 is formed, a correspondence plane S2 on which the correspondence electrode 232 is formed, and a dust collecting plane S3 on which the discharge electrode 231 and the correspondence electrode 232 are not formed and only the dust collecting electrodes 221 and 222 are formed. The discharge electrode 231 formed on the discharge plane S1 and the correspondence electrode 232 formed on the correspondence plane S2 function as a charging part. The plurality of dust collecting planes S3 are provided between the discharge plane S1 and the correspondence plane S2. For example, one discharge plane S1 may be provided at the middle of the two correspondence planes S2 and five dust collecting planes S3 may be provided between the discharge plane S1 and the correspondence plane S2. However, in FIGS. 8 to 10, two dust collecting plane S3 are illustrated between the discharge plane S1 and the correspondence plane S2 for convenience of illustration.

Referring to FIG. 10, negative electrodes 222 and 232 are formed over the majority of the width of the electric dust collection device 2 in a first plane S11 that is the correspondence plane S2. An approximately half of the width of a second plane S12 facing the first plane S11 on which the negative electrode is formed is removed, and a positive electrode 221 is formed on the remaining portion. The positive electrode 221 formed on the second plane S12 and the portion 222 of the negative electrode formed on the first plane S11 operate as dust collecting electrodes forming an electric field that removes the dust contained in air passing between the first plane S11 and the second plane S12.

An approximately half of the width of a third plane S13 which is the dust collecting plane S3 and faces the second plane S12 that is provided below the correspondence plane S1 and on which the positive electrode 221 is formed is removed, and the negative electrode 222 is formed on the remaining portion. The positive electrode 221 formed on the second plane S12 and the negative electrode 222 formed on the third plane S13 operate as the dust collecting electrodes forming the electric field that removes the dust contained in air passing between the second plane S12 and the third plane S13.

A discharge electrode 231 is formed on a fourth plane S14 facing the third plane S13 on which the negative electrode 222 is formed. In detail, a part of the width of the fourth plane S14, that is, the width C2 that is approximately half of the width C1 of the part removed in the third plane S13 is removed. Therefore, the width C2 of the part removed in the fourth plane S14 is smaller than the width C1 of the removed part of the third plane S13. The positive electrode 221 is formed on the fourth plane S14 to have a width corresponding to the width of the negative electrode 222 formed on the third plane S13. As illustrated in FIG. 11, a plurality of discharge electrodes 231 extend from the positive electrode 221 on the fourth plane S14 toward the cut part. Each of the discharge electrodes 231 is formed in a strip shape having a narrow width W. At this time, the discharge electrode 231 is positioned between the base film 201 and the cover film 202, and only one end 231*a* of the discharge electrode 231 is exposed to the outside. Therefore, a corona discharge may occur between the negative electrode 232 provided on the first plane S11 and one ends 231*a* of the discharge electrodes 231 provided in the fourth plane S14. Accordingly, the portion 232 of the negative electrode of the first plane S11 functions as a correspondence electrode generating a corona discharge together with the discharge electrodes 231. Further, the positive electrode 221 formed on the fourth plane S14 and the negative electrode 222 formed on the third plane S13 operate as the dust collecting electrodes forming the electric field that removes the dust contained in air passing between the third plane S13 and the fourth plane S14.

On the other hand, since the discharge electrodes 231 continue to wear when the discharge continues, the length L of the discharge electrode 231 may be formed 5 times or more the width W of the discharge electrode 231 in order to increase the lifetime of the discharge electrode 231.

An approximately half of the width of a fifth plane S15 facing the fourth plane S14 on which the discharge electrodes 231 are formed is removed, and the negative electrode 222 is formed on the remaining portion, as in the third plane S13 described above. The positive electrode 221 formed on the fourth plane S14 and the negative electrode 222 formed on the fifth plane S15 form the electric field that removes the dust contained in air passing between the fourth plane S14 and the fifth plane S15.

An approximately half of the width of a sixth plane S16 which is the dust collecting plane S3 and faces the fifth plane S15 on which the negative electrode is formed is removed, and the positive electrode 221 is formed on the remaining portion, as in the second plane S12 described above. The positive electrode 221 formed on the sixth plane S16 and the negative electrode 222 formed on the fifth plane S15 form the electric field that removes the dust contained in air passing between the fifth plane S15 and the sixth plane S16.

The negative electrodes 222 and 232 are formed over the majority of the width of a seventh plane S17 facing the sixth plane S16 on which the positive electrode 221 is formed as in the first plane S11 described above. The negative electrode 232 formed on the seventh plane S17 functions as a correspondence electrode generating a corona discharge together with the discharge electrodes 231 provided in the fourth plane S14 described above. The positive electrode 221 formed on the sixth plane S16 and the negative electrode 222 formed on the seventh plane S17 form the electric field that removes the dust contained in air passing between the sixth plane S16 and the seventh plane S17.

In the electric dust collection device 2 having the above-described structure, air moves in the direction of arrow in FIG. 10. In other words, the air supplied by the fan disposed outside the electric dust collection device 2 moves from a side where the flat plate is removed to a side where the flat plate is not removed.

Since the corona discharge is generated by the discharge electrode and the correspondence electrode at the portions where the flat plates are removed, the dust contained in the air passing between the discharge electrode and the correspondence electrode is charged to have a positive charge.

The air including the positively charged dust passes between the plurality of flat plates in which the positive electrodes and the negative electrodes are alternately formed. While the air passes through the space between the plurality of flat plates, the charged dust is adhered to the flat plates on which the negative electrode is formed by the electric field formed between the plurality of flat plates, and is removed from the air. The dust-removed air is discharged to the outside through an opening formed in the electric dust collection device.

With the electric dust collection device according to an embodiment of the present invention as illustrated in FIGS. 8 to 10, since the charging part for charging dust and the dust collecting part for collecting the dust are integrally formed in a single insulating sheet, there is an advantage that the manufacturing is more convenient than the case where the charging part and the dust collecting part are formed separately.

Figure 12:
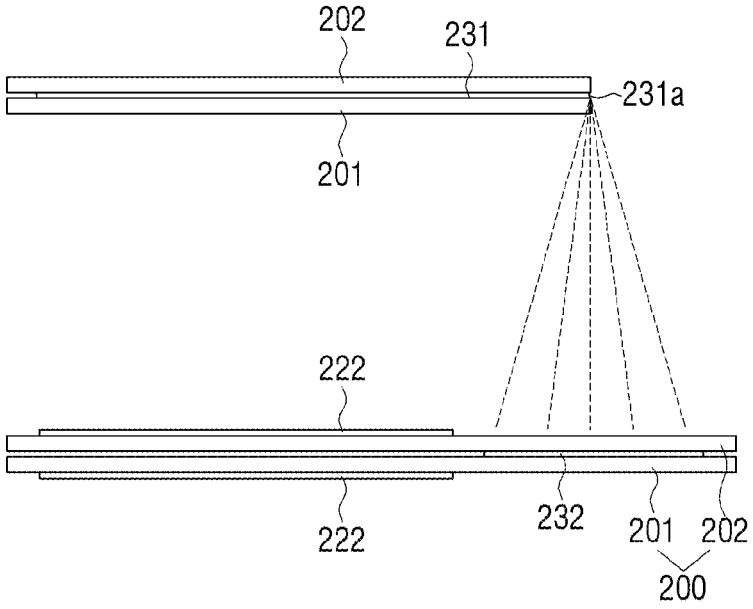
FIG. 12 is a view illustrating another example of a correspondence electrode in an electric dust collection device according to an embodiment of the present invention.

FIG. 12 is a view illustrating a modified example of a correspondence electrode in an electric dust collection device according to an embodiment of the present invention.

Referring to FIG. 12, a discharge electrode 231 provided at the upper portion is formed between the base film 201 and the cover film 202, and one end 231*a* of the discharge electrode 231 is exposed from between the base film 201 and the cover film 202.

A correspondence electrode 232 provided at the lower portion is formed in the inside of the insulating sheet 200, that is, between the base film 201 and the cover film 202. At this time, the negative electrode 222 which is the dust collecting electrode is formed on the outer surface of each of the base film 201 and the cover film 202. Therefore, a corona discharge occurs between one end 231*a* of the discharge electrode 231 exposed to the outside and the correspondence electrode 232 formed inside the insulating sheet 200, as illustrated in FIG. 12. When the correspondence electrode is formed inside the insulating sheet, the amount of generated ozone may be reduced. When the correspondence electrodes 232 are exposed to the outside as in the embodiment illustrated in FIGS. 8 to 10, the amount of generated ozone is larger than when the correspondence electrode 232 is insulated. In reference, although not illustrated in FIG. 12, a plurality of bent portions on which the dust collecting electrodes are formed are provided between the insulating sheets 200 on which the discharge electrode 231 and the correspondence electrode 232 are formed.

Figure 13:
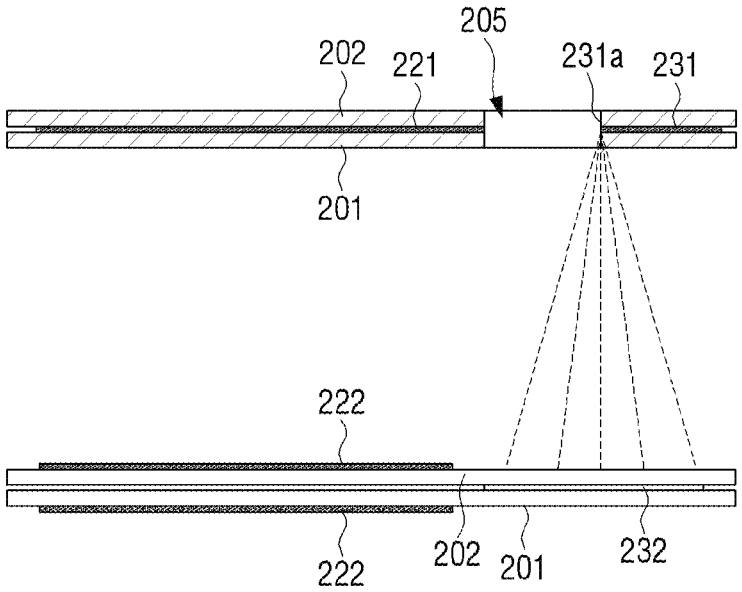
FIG. 13 is a view illustrating another example of a discharge electrode in an electric dust collection device according to an embodiment of the present invention.

FIG. 13 is a view illustrating a modified example of a discharge electrode in an electric dust collection device according to an embodiment of the present invention.

Referring to FIG. 13, a cutout portion 205 in which one end of the discharge electrode 231 is exposed is formed on the downstream side of the air flow direction (arrow A). At this time, the correspondence electrode 232 provided at the lower portion is formed inside the insulating sheet 200 as in the embodiment of FIG. 12. Accordingly, a corona discharge occurs between the exposed end 231*a* of the upper discharge electrode 231 and the lower correspondence electrode 232.

Figure 14A:
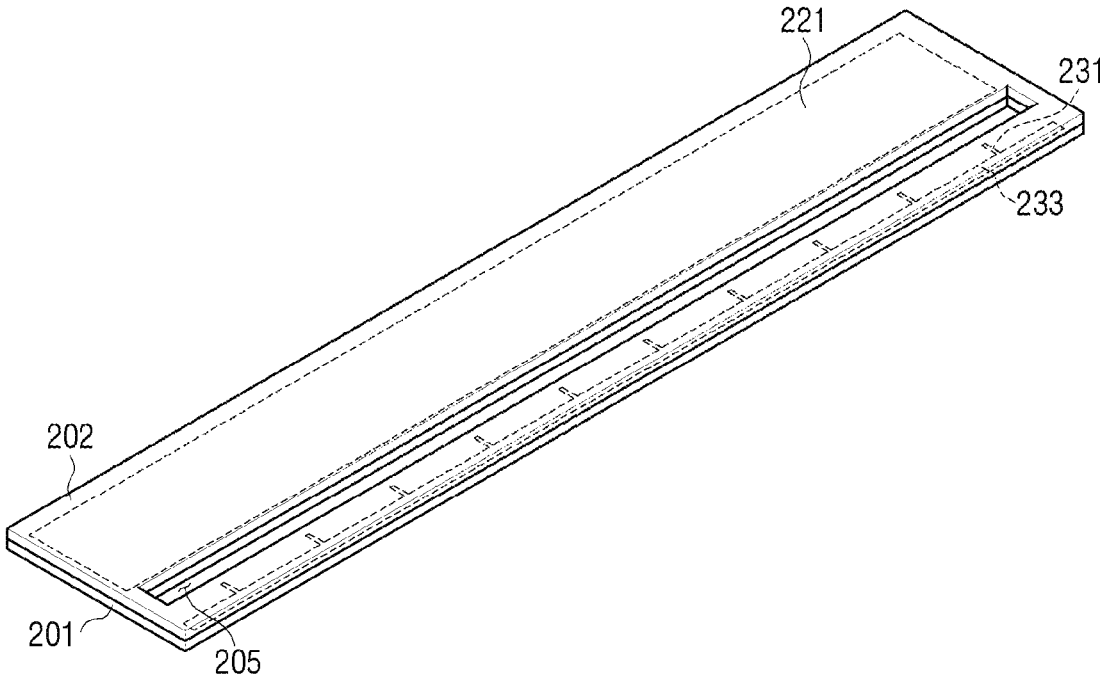
FIG. 14*a* is a perspective view illustrating the discharge electrode of FIG. 13.
Figure 14B:
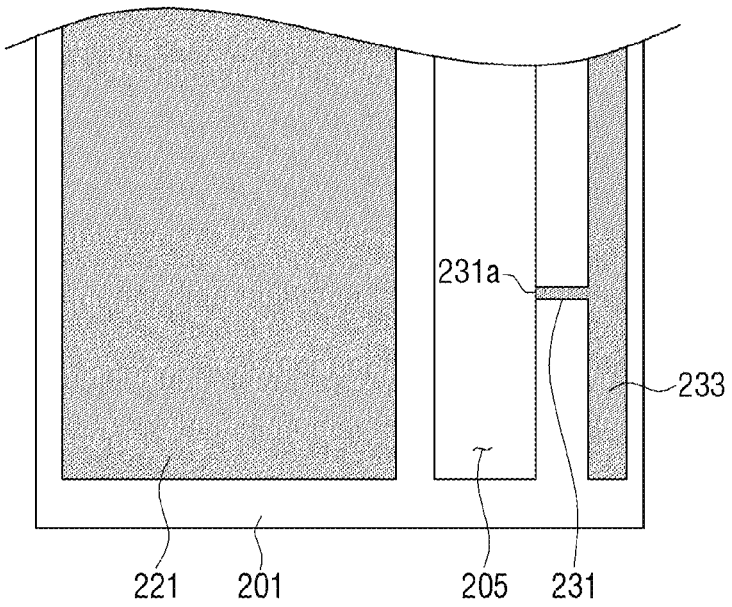
FIG. 14*b* is an enlarged partial view of the discharge electrode of FIG. 14*a;*

A part of the insulating sheet 200 in which the discharge electrode 231 of FIG. 13 is formed is illustrated in FIGS. 14*a* and 14*b*. FIG. 14*a* is a perspective view illustrating the discharge electrodes of FIG. 13, and FIG. 14*b* is an enlarged partial view of the discharge electrode of FIG. 14*a*.

Referring to FIGS. 14*a* and 14*b*, the insulating sheet 200 in which the discharge electrodes 231 are formed includes three parts. The insulating sheet 200 is formed by overlapping two insulating films, that is, the base film 201 and the cover film 202. In a first part, a positive electrode 221 serving as the dust collecting electrode is formed inside the insulating sheet 200. A second part is provided adjacent to the first part, and a rectangular through hole 205 penetrating the insulating sheet 200 is formed. A third part is provided adjacent to the second part, and a plurality of discharge electrodes 231 are formed inside the insulating sheet 200. One end 231*a* of each of the plurality of discharge electrodes 231 is exposed through the through hole 205. In other words, one end 231*a* of each of the discharge electrodes 231 is exposed between the base film 201 and the cover film 202 on the side wall of the through hole 205. The other ends of the plurality of discharge electrodes 231 are connected to a base electrode 233.

In the case of the electric dust collection device as illustrated in FIG. 8, since the exposed end 231*a* of the discharge electrode 231 is formed on the upstream side in the air flow direction, there is a possibility that a user's finger touches the exposed end of the discharge electrode. However, when the exposed end 231*a* of the discharge electrode is formed on the downstream side of the air flow direction like the electric dust collection device as illustrated in FIG. 13, the user's finger may be prevented from touching the exposed end 231*a* of the discharge electrode.

Hereinafter, a process of manufacturing a dust collecting member used in an electric dust collection device according to an embodiment of the present invention will be described with reference to FIG. 16.

Figure 16:
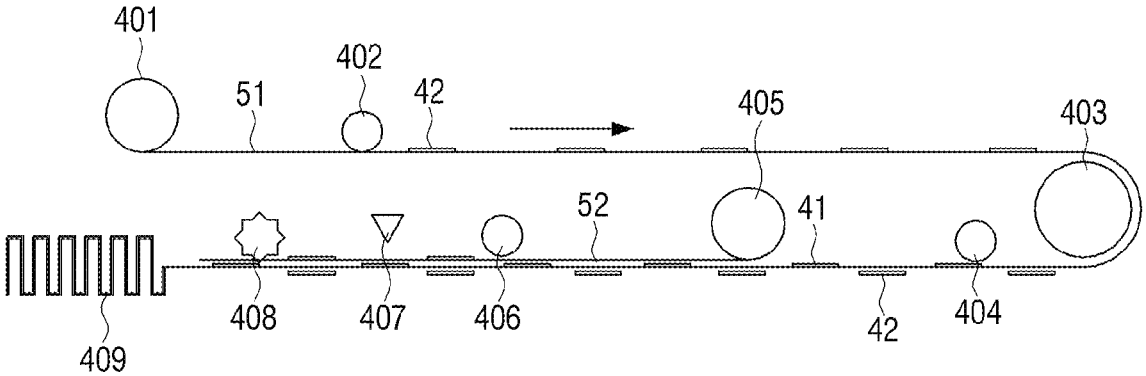
FIG. 16 is a view illustrating a process of manufacturing a dust collecting member of an electric dust collection device according to an embodiment of the present invention.

FIG. 16 is a view illustrating a process of manufacturing a dust collecting member of an electric dust collection device according to an embodiment of the present invention.

The manufacturing process of the dust collecting member may include a base film supply section 401, a first negative electrode forming section 402, an inverting section 403, a positive electrode forming section 404, a cover film supply section 405, a second negative electrode forming section 406, a gap holding member forming section 407, a machining section 408, and a bending section 409.

The base film supply section 401 continuously supplies the base film 51 wound on a roll.

The first negative electrode forming section 402 is provided on a side of the base film supply section 401 and forms negative electrodes 42 on the top surface of the base film 51. The first negative electrode forming section 402 may be formed to print carbon ink on the top surface of the base film 51.

The inverting section 403 causes the surface of the base film 51 on which the negative electrodes 42 are formed to face downward and the surface of the base film 51 on which the negative electrodes 42 are not formed to face upward. In other words, the inverting section 403 inverts the base film 51 by 180 degrees.

The positive electrode forming section 404 is provided on a side of the inverting section 403 and forms positive electrodes 41 on the top surface of the base film 51. At this time, the positive electrodes 41 are formed to be spaced apart from the negative electrodes 42 formed on the bottom surface of the base film 51 by a predetermined distance.

The cover film supply section 405 is provided on a side of the positive electrode forming section 404 and covers the top surface of the base film 51 on which the positive electrodes 41 are formed with a cover film 52. The cover film supply section 405 continuously supplies the cover film 52 wound on a roll to overlap the base film 51 to be continuously supplied.

The second negative electrode forming section 406 is provided on a side of the cover film supply section 405 and forms negative electrodes 43 on a top surface of the cover film 52 attached to the base film 51. At this time, the second negative electrode forming section 406 forms the negative electrodes 43 at positions corresponding to the negative electrodes 42 formed on the bottom surface of the base film 51.

The gap holding member forming section 407 forms gap holding members on the top surface of the cover film 52 at predetermined intervals. The gap holding members may be formed on the top surface of the cover film 52 by melting the hot melt. The gap holding members may be formed continuously in the moving direction of the cover film 52, or may be formed in spot shapes.

The machining section 408 is provided on a side of the gap holding member forming section 407 and forms through holes or slits in the cover film 52 and the base film 51.

For example, in the case of the dust collecting member 20 as illustrated in FIG. 4, the openings 34 are formed through the base film 51 and the cover film 52 between the positive electrode 41 and the negative electrode 42. In the case of the dust collecting member 20' as illustrated in FIG. 7, the slit 55 for cutting between the positive electrode 41 and the negative electrode 43 and two through holes 56 provided at both ends of the slit 55 are formed. In the case of the electric dust collection device 2 in which the charging part and the dust collecting part are integrated as illustrated in FIG. 8, the cutout for exposing the discharge electrode 231 and the correspondence electrodes 232 is formed.

The bending section 409 bends the processed insulating sheet 50 into a substantially square wave shape at predetermined intervals, thereby completing the dust collecting member 20.

Figure 17:
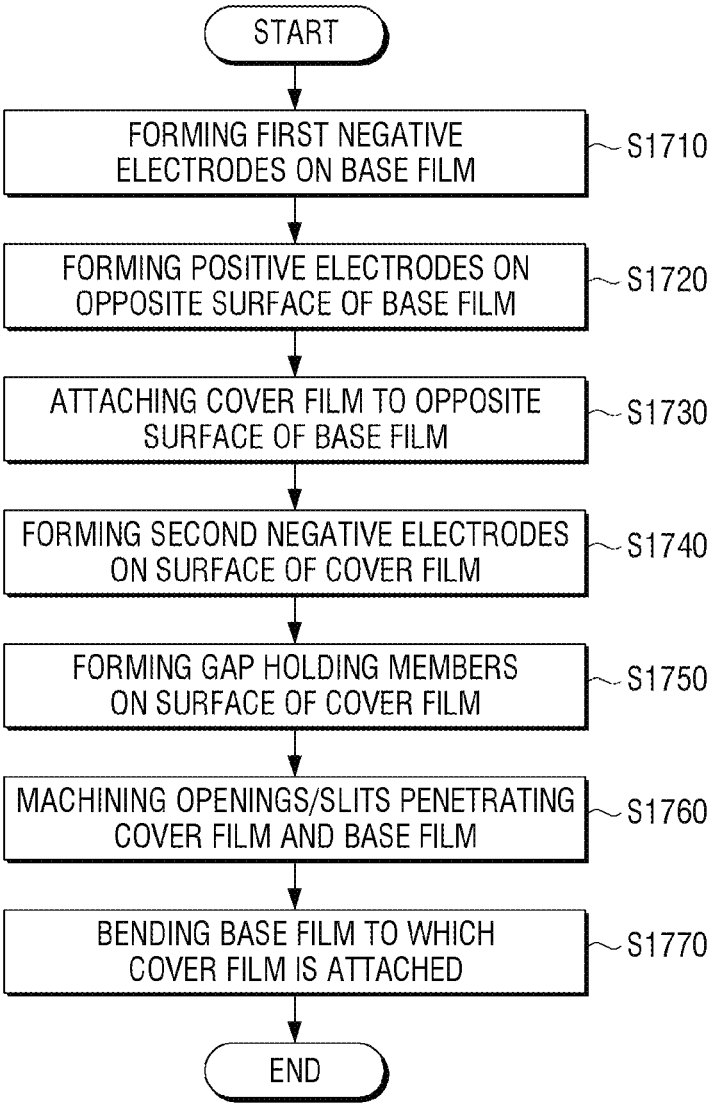
FIG. 17 is a flowchart illustrating a method of manufacturing an electric dust collection device according to an embodiment of the present invention.

A manufacturing method of forming the dust collecting member according to an embodiment of the present invention through the above-described manufacturing process will be described with reference to FIG. 17.

First, the base film supply section 401 continuously supplies the base film 51.

Then, the first negative electrode forming section 402 forms the first negative electrodes 42 on one surface of the base film 51 which is continuously supplied (S1710).

The base film 51 which is continuously supplied is inverted by 180 degrees by the inverting section 403 so that the surface on which the first negative electrodes 42 are formed becomes the bottom surface and the opposite surface of the base film 51 on which the first negative electrodes 42 are not formed becomes the top surface.

Then, the positive electrode forming section 404 forms the positive electrodes 41 on the top surface of the base film 51 so to be spaced apart from the first negative electrodes 42 by a predetermined distance.

Thereafter, the cover film supply section 405 continuously supplies the cover film 52 to attach the cover film 52 to the opposite surface of the base film 51. At this time, since the width of the cover film 52 is smaller than the width of the base film 51, the cover film 52 is attached to the base film 51 so that one side of the cover film 52 is aligned with one side of the base film 51. Therefore, a portion of the positive electrode 41 is exposed near one side of the base film 51 to which the cover film 52 is not attached.

Then, the second negative electrode forming section 406 forms the second negative electrodes 43 at positions facing the first negative electrodes 42 of the base film 51 on the surface of the cover film 52.

Thereafter, the gap holding member forming section 407 forms the gap holding members in the moving direction of the cover film 52 on the surface of the cover film 52.

Then, the machining section 408 forms the openings or the slits penetrating the base film 51 and the cover film 52 between the second negative electrodes 43 and the positive electrodes 41.

Finally, the bending section 409 bends the base film 51 to which the cover film 52 is attached with respect to the opening, thereby completing the dust collecting member 20.

The electric dust collection device according to an embodiment of the present invention as described above can produce the dust collecting member by continuously bending a single sheet of insulating sheet, so that the material cost and the machining cost may be reduced and the production efficiency and the manufacturing speed may be improved.

The present invention has been described above by way of example. The terms used herein are for the purpose of description and should not be construed as limiting. Various modifications and variations of the present invention are possible in light of the above descriptions. Therefore, the present invention can be freely carried out within the scope of the claims unless otherwise specified.

The invention claimed is:

1. An electric dust collection device comprising:

a charging part; and a dust collecting part provided downstream of the charging part, wherein the dust collecting part comprises a plurality of bent portions formed by continuously bending an insulating sheet, wherein each of the plurality of bent portions comprises:

two planes bent to face each other at a predetermined gap; and a connecting wall connecting respective ends of the two planes in a vertical direction and provided with an opening, and wherein a positive electrode is formed in one of the two planes and a negative electrode is formed in another one of the two planes.

2. The electric dust collection device of claim 1, wherein the positive electrode of each of the plurality of bent portions is connected to each other and the negative electrode of each of the plurality of bent portions is connected to each other.

3. The electric dust collection device of claim 1, wherein the positive electrode and the negative electrode are formed by printing with carbon ink or silver-containing paint or by depositing aluminum on a surface of the insulating sheet.

4. The electric dust collection device of claim 1, wherein one of the positive electrode and the negative electrode is formed inside the insulating sheet and another one of the positive electrode and the negative electrode is formed on a surface of the insulating sheet, and wherein a part of the one of the positive electrode and the negative electrode formed inside the insulating sheet is exposed to an outside for connection with an external power source.

5. The electric dust collection device of claim 4, wherein the positive electrode and the negative electrode are alternately formed in a longitudinal direction of the insulating sheet.

6. The electric dust collection device of claim 4, wherein the insulating sheet includes a base film and a cover film which are overlapped with each other, and the one of the positive electrode and the negative electrode is located between the base film and the cover film.

7. The electric dust collection device of claim 6, wherein a width of the cover film is smaller than a width of the base film and the one of the positive electrode and the negative electrode positioned between the base film and the cover film is partially exposed to an outside of the cover film.

8. The electric dust collection device of claim 1, wherein a plurality of gap holding members are provided between the two planes of the plurality of bent portions.

9. The electric dust collection device of claim 8, wherein the plurality of gap holding members are provided on ends opposite to connecting walls of the two planes of the plurality of bent portions.

10. The electric dust collection device of claim 9, wherein the gap holding members are formed of a conductive material.

11. The electric dust collection device of claim 10, wherein portions of the plurality of gap holding members protrude from one end of the two planes of the plurality of bent portions and are in contact with each other.

12. The electric dust collection device of claim 8, wherein the plurality of gap holding members are formed of a thermally fusible adhesive or a double-sided tape.

13. The electric dust collection device of claim 1, wherein each of the two planes of the plurality of bent portions includes a middle part in which an electric field forming portion of the positive electrode or the negative electrode is provided and connecting parts, in which a power connection part of the positive electrode or the negative electrode is provided, that are provided on both sides of the middle part, and wherein a width of the middle part is larger than a width of a one of the connecting parts.

14. The electric dust collection device of claim 1, wherein the charging part is formed by extending the positive electrode and the negative electrode formed in the plurality of bent portions toward an upstream side of the dust collecting part.

15. The electric dust collection device of claim 14, wherein the charging part includes a discharge electrode and a correspondence electrode, wherein the discharge electrode is formed in a strip shape at one side of the positive electrode or the negative electrode and provided inside the insulating sheet, wherein one end of the discharge electrode is exposed to an outside of the insulating sheet, and wherein the correspondence electrode has a polarity opposite to that of the discharge electrode and is extended from one side of the negative electrode or the positive electrode.

* * * * *